US005359146A

United States Patent [19]

Funaki et al.

[11] Patent Number: 5,359,146

[45] Date of Patent: Oct. 25, 1994

[54] MUSICAL TONE SYNTHESIZING APPARATUS HAVING SMOOTHLY VARYING TONE CONTROL PARAMETERS

[75] Inventors: Tomoyuki Funaki; Iwao Higashi; Toru Kitayama; Hideyuki Masuda; Toshifumi Kunimoto, all of Hamamatsu, Japan

[73] Assignee: Yamaha Corporation, Hamamatsu, Japan

[21] Appl. No.: 838,572

[22] Filed: Feb. 19, 1992

[30] Foreign Application Priority Data

Feb. 19, 1991 [JP] Japan ..... 3-024923
Apr. 26, 1991 [JP] Japan ..... 3-097760
May 16, 1991 [JP] Japan ..... 3-111866

[51] Int. Cl.[5] ..... G10H 1/057; G10H 1/08; G10H 1/12

[52] U.S. Cl. ..... 84/624; 84/627; 84/660; 84/661; 84/663; 84/DIG. 9; 84/DIG. 10

[58] Field of Search ..... 84/607, 622, 623, 624, 84/660, 661, DIG. 10, DIG. 9, 627, 663

[56] References Cited

U.S. PATENT DOCUMENTS 4,785,706 11/1988 Toshifumi ..... 84/DIG. 10
4,907,484 3/1990 Suzuki et al. .
4,984,276 1/1991 Smith .
5,131,310 7/1992 Kunimoto ..... 84/622

*Primary Examiner*—Stanley J. Witkowski
*Attorney, Agent, or Firm*—Graham & James

[57] ABSTRACT

A musical tone synthesizing apparatus provides a time-varying signal processing circuit the transfer function of which gradually varies over time in order to gradually vary over time the tone color of a synthesized musical tone. A number of time-varying signal processing circuits are presented. An interpolation-type-time-varying signal processing circuit is provided with interpolators for interpolating control parameters generated based on a desired musical tone, a signal processing circuit carrying out a signal operation based on the interpolated control parameters on an input signal incomming thereto. A mixing-type or distribution-type time-varying signal processing circuit is provided with a plurality of signal processing circuits for carrying out signal operations based on control parameters on input signals, and with a mixer which mixes the output signals of the signal processing circuits in such a way that the mixing ratio gradually varies over time or with a distribution circuit which distributes an input signal to the signal processing circuits in such a way that the distribution ratio gradually varies over time.

17 Claims, 20 Drawing Sheets

| A | B | C | D | OUT 1 | OUT 2 |
|---|---|---|---|---|---|
| 0 | 0 | 0 | 0 | NL 1 | NL 1 |
| 1 | 0 | 0 | 0 | NL 1 | NL 2 |
| 0 | 1 | 0 | 0 | NL 1 | NL 3 |
| 1 | 1 | 0 | 0 | NL 1 | NL 4 |
| 0 | 0 | 1 | 0 | NL 2 | NL 1 |
| 1 | 0 | 1 | 0 | NL 2 | NL 2 |
| 0 | 1 | 1 | 0 | NL 2 | NL 3 |
| 1 | 1 | 1 | 0 | NL 2 | NL 4 |
| 0 | 0 | 0 | 1 | NL 3 | NL 1 |
| 1 | 0 | 0 | 1 | NL 3 | NL 2 |
| 0 | 1 | 0 | 1 | NL 3 | NL 3 |
| 1 | 1 | 0 | 1 | NL 3 | NL 4 |
| 0 | 0 | 1 | 1 | NL 4 | NL 1 |
| 1 | 0 | 1 | 1 | NL 4 | NL 2 |
| 0 | 1 | 1 | 1 | NL 4 | NL 3 |
| 1 | 1 | 1 | 1 | NL 4 | NL 4 |

FIG.25

MUSICAL TONE SYNTHESIZING APPARATUS HAVING SMOOTHLY VARYING TONE CONTROL PARAMETERS

BACKGROUND OF THE INVENTION

The present invention relates to a musical tone synthesizing apparatus which can control over time the tone color of a synthesized musical tone.

BACKGROUND ART

Methods for synthesizing the musical sounds of nonelectronic musical instruments are known in which the mechanism of sound generation in the musical instrument is simulated to obtain a tone generation model which is then applied to the synthesis of the sounds of the target musical instrument.

In the above synthesis, non-linear transformation circuits, which transform an input signal to an output signal based on a predetermined non-linear function, are used as simulation models of non-linear elements of non-electronic musical instruments. For example, reeds of wind instruments are non-linear elements which have non-linear elastic characteristics. The tone color of wind instruments depend on the elastic characteristics of the reeds. It is neccesary to accurately simulate the non-electronic characteristics of the target musical instrument in order to obtain the natural musical tones.

In addition, an FIR (Finite Impulse Response) filter is preferably used for the synthesis of musical tones in order to control the tone color of the synthesized musical tone. The FIR filters are particularly employed in simulation circuits for simulating the operations of resonators such as the resonator tube of a wind instrument, the string of a struck string instrument or the string of a bowed string instrument. The simulation method will be described, hereinafter.

In the case where the cylindrical resonator tube of a wind instrument such as is shown in FIG. 31 is simulated, the impulse response of the tube is observed. An impulse is input at the connecting point between the mouth piece and the tube in order to observe the impulse response. The input impulse propagates through the tube toward the terminal portion of the tube. The impulse is then reflected at the terminal portion of the tube and is fed back to the mouth piece as a reflected waveform. The reflected waveform is observed at the input point such as shown in FIG. 32 after a predetermined time T has elapsed from the time point at which the impulse was input. In the case where the length of the tube is L, and the sound velocity is V, time T is determined as $T=2\ L/V$. In the case where an impulse is input to the conical resonator tube shown in FIG. 33, a reflected waveform such as is shown in FIG. 34 is observed.

In the case where a bowed string instrument such as the violin shown in FIG. 35 is simulated, an impulse is input at the point of the target string at which the string is bowed by a bow. As a result, first and second reflected waveforms shown in FIGS. 36(*a*) and 36(*b*) are observed at the impulse input point. The first reflected waveform is observed after a predetermined time $T_1$ has elapsed from the time point at which the impulse was input. The second reflected waveform is observed after a predetermined time $T_2$ has elapsed from the time point at which the impulse was input. In the case where the length between the impulse input point and the bridge by which the terminal portion of the string is fixed is $L_1$, time $T_1$ is determined as $T_1=2\ L_1/V$. In the case where the length between the impulse input point and the nut by which the other terminal portion of the string is fixed is $L_2$, time $T_2$ is determined as $T_2=2\ L_2/V$. In the case where the string of a piano is simulated, an impulse is input at a struck point of the string as shown in FIG. 37. In this case, reflected waveforms having a complex shape such as shown in FIGS. 38(*a*) and 38(*b*) are observed because the propagation characteristics of the vibration depend on the elastic of the string in the case where the string is a large string such as a piano string.

An impulse response thus obtained is sampled by a predetermined sampling period. The sample data obtained by the sampling are set to multipliers employed in an FIR filter as filtering coefficients. In this manner, an FIR filter which has a impulse response Identical to the impulse response obtained from the target instrument is obtained. The FIR filter thus obtained is employed in a musical tone synthesizing apparatus as a tone color control filter to obtain the desired musical tone.

However, the tone color of the musical tones generated by non-electronic musical instruments are varied over time. In addition, the tone color of the musical tone is varied in response to the variation of performance parameters such as a variation of the breath pressure blowed into a mouth piece of a wind instrument. There are methods in which filtering coefficients of the FIR filter or non-linear function tables used for the non-linear transformation are changed in order to vary the tone color of the synthesized musical tone during synthesis of the musical tone. These methods, however, cause the generation of a click noise due to the changing of the filtering coefficients or the non-linear transformation function.

On the other hand, a method for synthesizing interesting musical tones is required in which the tone color of the synthesized musical tone is gradually varied over time in a interesting manner which cannot be observed in non-electronic musical instruments. However, there is no technique which satisfies such a requirement.

SUMMARY OF THE INVENTION

In consideration of the above, it is an object of the present invention to provide a musical tone synthesizing apparatus which can synthesize musical tones the tone characteristics of which gradually vary over time without generating a click noise.

In an aspect of the present invention, there is provided a musical tone synthesizing apparatus comprising:

a parameter generation circuit for generating control parameters based on a desired musical tone; and an interpolation-type-time-varying signal processing circuit for controling the tone characteristics of the synthesized musical tone so as to gradually vary over time.

In the interpolation-type time varying signal processing circuits, the following circuits are provided:

(a) interpolation circuits for interpolating over time the control parameters, and for outputing the interpolated control parameters which gradually vary over time; and (b) a signal processing circuit for transforming an input signal to an output signal based on the interpolated control parameters.

The present Invention further provides a musical tone synthesizing apparatus comprising:

a parameter generation circuit for generating control parameters based on a desired musical tone; and a mixing-type-time-varying signal processing means for controlling the tone characteristics of the synthesized musical tone so as to gradually vary over time.

In the mixing-type-time-varying signal processing circuit, the following circuits are provided:

(a) a plurality of signal processing circuits for transforming a common input signal to a plurality of output signals based on the corresponding control parameters; and (b) a mixing circuit for mixing the output signals of said signal processing circuits in such a way that the mixing ratio gradually varies over time.

The present Invention further provides a musical tone synthesizing apparatus comprising:

a parameter generation circuit for generating control parameters based on a desired tone color; and a distribution-type-time-varying signal processing circuit for controlling the tone characteristics of the synthesized musical tone so as to gradually vary over time.

In the distribution-type-time-varying signal processing circuit, the following circuits are provided:

(a) a plurality of signal processing circuits for transforming input signals to output signals based on the corresponding control parameters; and (b) a distribution circuit for distributing an input signal for the signal processing circuits in such a way that the distribution ratio gradually varies over time..

The present invention further provides a musical tone synthesizing apparatus comprising:

(a) non-linear transformation circuits for transforming an common input signal to a plurality of output signals based on predetermined non-linear transformation functions; and (b) a mixing circuit for mixing the output signals of the non-linear transformation circuits in such a way that the mixing ratio gradually varies over time..

The present invention further provides a musical tone synthesizing apparatus comprising:

an address generator for sequentially generating waveform address based on a desired musical tone; and time-varying waveform memory circuit for controlling the tone characteristics of the synthesized musical tone so as to gradually vary over time.

In the time-varying waveform memory circuit, the following circuits are provided:

(a) a memory for storing the waveform data of a plurality of waveforms and for sequentially reading-out waveform data of the waveforms based on the waveform address; and (b) a mixing circuit for mixing the read-out waveform data of the memory in such a way that the mixing ratio gradually varies over time.

The present invention further provides a musical tone synthesizing apparatus comprising:

an envelope generating circuit for generating a plurality of envelope signals which gradually rise and gradually fall;

at least one linear signal processing circuit for carrying out signal processing Including delay processing on an input signal incoming thereto;

a plurality of non-linear signal processing circuits for carrying out a non-linear signal processing on input signals incoming thereto;

a plurality of multipliers for multiplying the output signals of the non-linear signal processing circuits with the corresponding envelope signals; and a junction circuit for mixing the output signals of the linear signal processing circuits and the multipliers, and for generating input signals for the linear signal processing circuits and the non-linear signal processing circuits based on the mixing result.

Further objects and advantages of the present invention will be understood from the following description of the preferred embodiments with reference to the drawing.

BRIEF DESCRIPTION OF THE DRAWING

FIG. 25 shows the operation of the waveform processing circuit shown in FIG. 23.

DETAILED DESCRIPTION OF THE PREFERRED EMBODIMENTS

[1] First Preferred Embodiment

Figure 1:
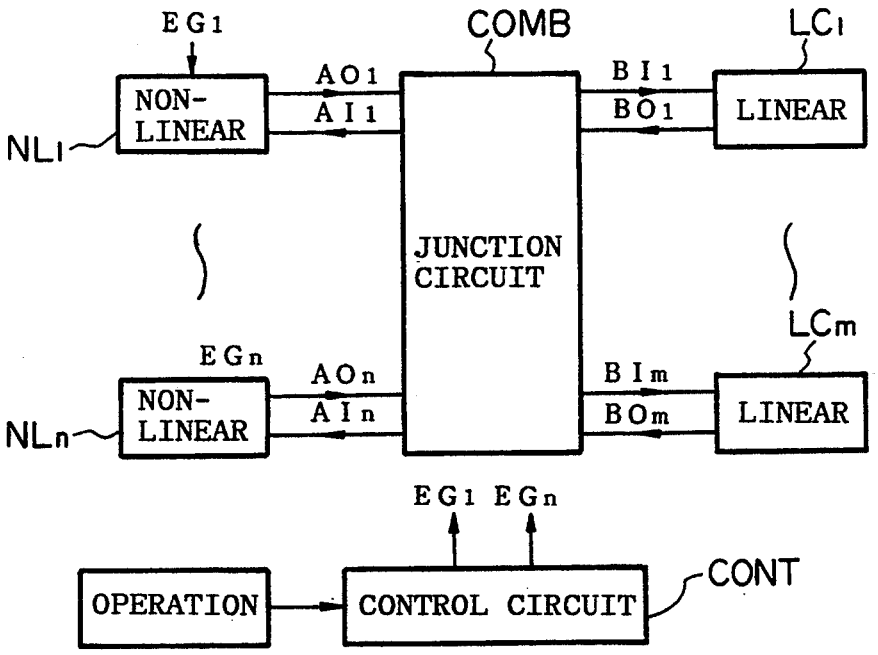
FIG. 1 is a block diagram showing the configuration of a musical tone synthesizing apparatus of the first preferred embodiment of the present invention.

FIG. 1 is a block diagram showing the configuration of a musical tone synthesizing apparatus of the first preferred embodiment. This musical tone synthesizing apparatus is designed to synthesize musical tones generated by a fictional non-electronic musical instrument which has excitation mechanisms of various non-electronic musical instruments and resonators of various non-linear electronic musical instruments. In FIG. 1, $NL_1$ through $NL_n$ designate excitation circuits, each simulating one of the excitation mechanisms of non-electronic musical instruments. $LC_1$ through $LC_m$ designate linear signal processing circuits, each simulating the operation of one of the resonators of non-electronic musical instruments. COMB designates a junction circuit which combines non-linear signal processing circuits $NL_1$ through $NL_n$ and linear signal processing circuits $LC_1$ through $LC_m$. Junction circuit COMB performs an interface function for signal transmission between the linear signal processing circuits and the non-linear signal processing circuits. More specifically, signals $AO_1$ through $AO_n$, which are output from non-linear signal processing circuits $NL_1$ through $NL_n$, and signals $BO_1$ through $BO_m$ which are output from linear circuits $LC_1$ through $LC_m$, are input to junction circuit COMB. Junction circuit COMB mixes these input signals, and generates input signals $AI_1$ through $AI_n$ respectively for non-linear signal processing circuits $NL_1$ through $NL_n$, and input signals $BI_1$ through $BI_m$ for linear signal processing circuits $LC_1$ through $LC_m$. CONT designates a control circuit which controls the individual portions of the musical tone synthesizing apparatus. An operation means such as a keyboard (not shown), is connected to control circuit CONT. Control circuit CONT generates control signals for controlling the musical tone generation of the musical tone synthesizing apparatus in response to operational events such as a key-on event detected from the operation means. Control circuit CONT generates envelope signals $EG_1$ through $EG_n$ as the control signals when key-on events are supplied thereto. Envelope signal $EG_1$ through $EG_n$ respectively control the levels of signals $AO_1$ through $AO_n$ which are output respectively from non-linear circuit $NL_1$ through $NL_n$ and are supplied to junction circuit COMB. The other control signals for the musical tone generation are generated by control circuit CONT when key-on events are supplied to the control circuit.

Figure 2:
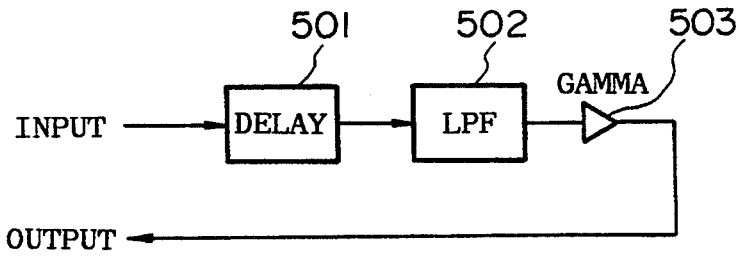
FIGS. 2 and 3 are block diagrams showing the configuration of examples of linear signal processing circuits employed in the musical tone synthesizing apparatus of the first preferred embodiment.
Figure 3:
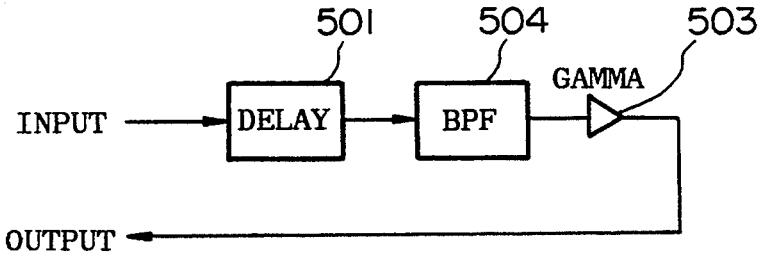

FIGS. 2 and 3 show examples of circuits which can be employed in the musical tone synthesizing apparatus as linear signal processing circuits $LC_1$ through $LC_m$. In FIGS. 2 and 3, 501 designates a delay circuit which delays an input signal supplied from Junction circuit COMB by a predetermined delay interval. 502 and 504 respectively designate a low-pass filter and a band-pass filter, each provided for simulating the acoustic loss of a resonator of a non-electronic musical instrument. 503 designate a multiplier which multiplies a predetermined coefficient GAMMA to an input signal which Is supplied from low-pass filter 502 or band-pass filter 504. Multiplier 503 is provided for simulating a phase reflection phenomenon in which the sound wave propagating through a resonator of a non-electronic musical instrument is reflected at the terminal portion of the resonator. When sound waves are reflected, the energy of the sound waves is attenuated. For this reason, coefficient GAMMA is determined so that the absolute value of GAMMA is less than one. In the case where the terminal portion of the resonator is closed, the phase of the sound wave propagating through the resonator is inverted when the sound wave is reflected at the terminal portion. In this case, a negative value is determined as coefficient GAMMA.

Figure 4:
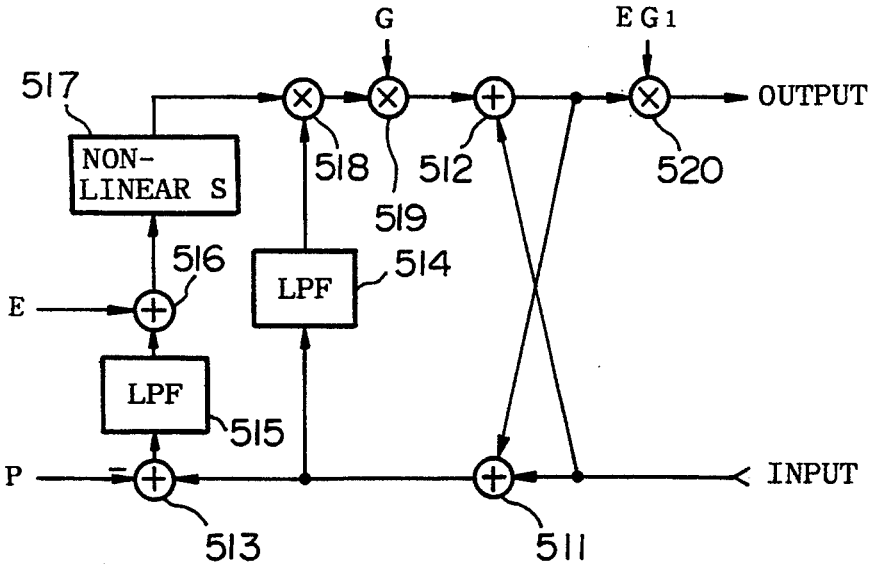
FIGS. 4 and 5 are block diagrams showing the configuration of examples of non-liner signal processing circuits employed in the musical tone synthesizing apparatus of the first preferred embodiment.
Figure 5:
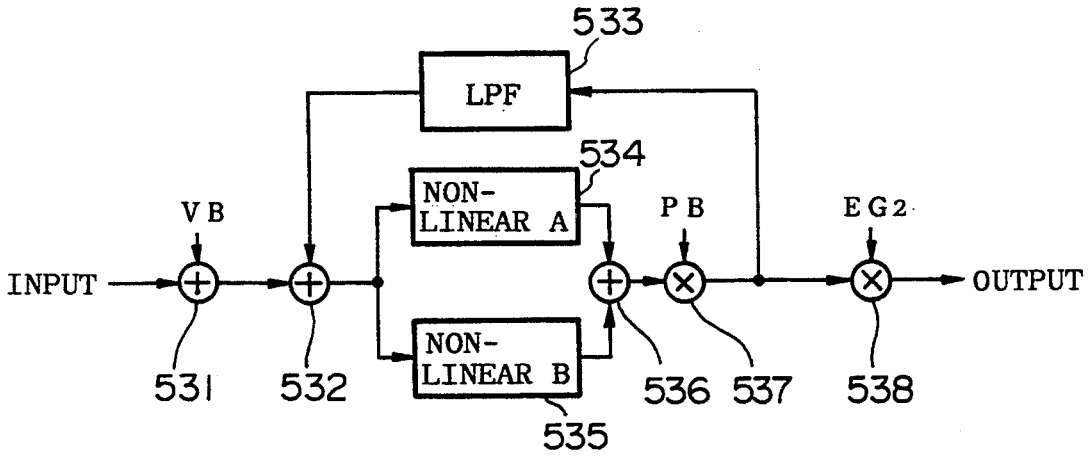

FIGS. 4 and 5 show examples of circuits which can be employed in the musical tone synthesizing apparatus as non-linear signal processing circuits $NL_1$ through $NL_n$. The circuit shown in FIG. 4 simulates the operation of a mouth piece of a non-electronic wind Instrument. In FIG. 4, a Junction unit constituted by adders 511 and 512 is provided for simulating a phenomenon in which the sound waves scatter at the connecting portion between the mouth piece and the resonator when the sound waves enter the connecting portion. The output signal from Junction circuit COMB is supplied to one input terminal of adder 511 and to one input terminal of adder 512. This signal corresponds to a sound wave (air pressure wave) which propagates from the resonator tube of a wind instrument to the mouth piece. The output signal of adder 512 is input to the other input terminal of adder 511. The output signal of adder 511 Is input to the other input terminal of adder 512. The output signal of adder 511 is supplied to a subtractor 513 and low-pass filter 514. This signal corresponds to a sound wave which propagates to the mouth piece from the resonator.

Figure 7:
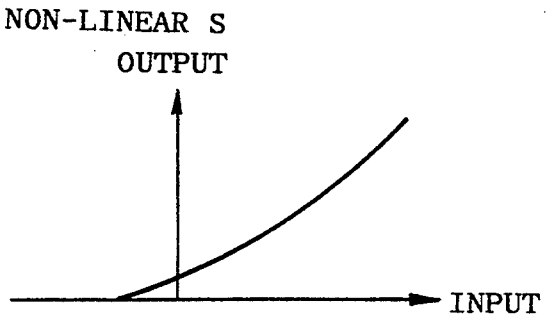
FIGS. 7 through 9 show input-output transformation characteristics of non-linear transformation circuits employed in the musical tone synthesizing apparatus of the first preferred embodiment.

Subtractor 513 subtract the output signal of adder 511 by a pressure signal P which is supplied from control circuit CONT when the musical tone generation starts. Pressure signal P corresponds to air pressure in the mouth of a performer who holds the mouth piece. The output signal of subtractor 513 corresponds to the pressure which is applied to the reed of the mouth piece. This signal passes through a low-pass filter 515 which is provided for simulating the dynamic response of the reed, whereby the higher frequency components of the signal are rejected. The output signal of low-pass filter 515 is input to one input terminal of adder 516. Embouchure signal E is supplied to the other input terminal of adder 516 by control circuit CONT. This signal E corresponds to the pressure which is applied to the mouth piece by the mouth of a performer. The output signal of adder 516 corresponds to the total pressure affected to the reed. This signal is input to a non-linear transformation circuit 517. Non-linear transformation circuit 517 is provided for simulating a non-linear characteristic of a variation of the sectional area of a slit formed between the reed and the mouth piece in response to the variation of the pressure affected to the reed. FIG. 7 shows an example of the input-output transmission characteristic of non-linear transformation circuit 517. In FIG. 7, the X-axis corresponds to the input signal which indicates the pressure applied to the reed, and the Y-axis corresponds to the output signal which indicates the sectional area of the slit. Non-linear transformation circuit 517 can be constituted by a ROM (Read Only Memory) which stores the non-linear function table indicated in FIG. 7 for example. The output signal of non-linear transformation circuit 517 is supplied to one input terminal of a multiplier 518. On the other hand, low-pass filter 514 rejects higher frequency components included in the output signal of adder 511 and outputs a signal not including the higher frequency components. The output signal of low-pass filter 514 is supplied to the other input terminal of multiplier 518. Multiplier 518 outputs a signal which indicates the flow velocity of the air flow passing through the slit formed between the mouth piece and the reed. A multiplier 519 multiplies the output signal of multiplier 518 by a coefficient G which Indicates the impedance of the mouth piece with respect to the air flow. As a result, a signal indicating the variation of the pressure in the mouth piece is obtained by multiplier 519 and is supplied to adder 512. Adder 512 outputs a signal corresponding to the air pressure wave (sound wave) which propagates from the mouth piece towards the resonator. Multiplier 520 multiplies the output signal of adder 512 by envelope signal EG1 which is supplied by control circuit CONT. The output signal of multiplier 520 is supplied to junction circuit COMB as an excitation signal.

Figure 8:
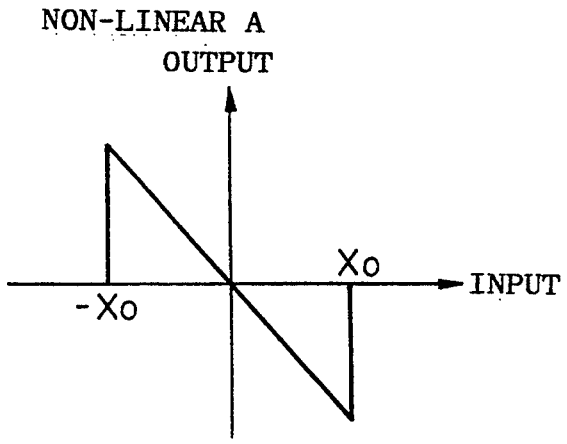
Figure 9:
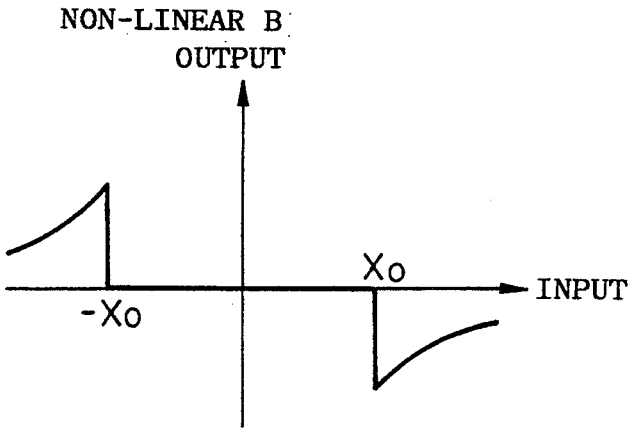

FIG. 5 shows another example of a non-linear signal processing circuit. This circuit is designed so as to simulate the excitation mechanism of a bowed string instrument such as a violin. The output signal of junction circuit COMB is supplied to one input terminal of an adder 531. This signal is a string velocity signal which indicates the velocity of a string of a violin. On the other hand, a bow velocity signal VB is supplied to the other input terminal of adder 581 from control circuit CONT. This signal corresponds to the velocity of a bow which is moved by a performer. Directions are defined with respect to the movements of the bow and string so that the positive direction of the movement of the bow equals the negative direction of the movement of the string. The sign of bow velocity signal VB indicates the direction of the movement of the bow, while the sign of the string velocity signal indicates the direction of the movement of the string. Accordingly, adder 531 outputs a relative velocity signal which indicates the relative velocity of the bow and the string. An adder 582 adds the relative velocity signal to the output signal of low-pass filter 533. The output signal of adder 532 is supplied to non-linear transformation circuits 534 and 585 as an input signal. Each non-linear transformation circuit transforms an input signal to an output signal based non-linear transformation function A or B. These non-linear transformation circuits are provided for simulating the movement of a string in response to the movement of a bow. FIGS. 8 and 9 respectively show non-linear transformation functions A and B presented by non-linear transformation circuits 584 and 535. In FIGS. 8 and 9, the X-axis corresponds to the input signals, and the Y-axis corresponds to the output signals. The output signals of non-linear transformation circuits 534 and 535 are summed by an adder 536. Accordingly, the input signal is transformed based on a transformation function which is obtained by adding non-linear transformation function A and non-linear transformation function B. In the case where the value of the relative velocity signal is greater than $-X_0$ and less than $X_0$, the value of transformation function B (FIG. 9) is 0. In this case, adder 536 outputs a signal which is obtained by transforming the relative velocity signal based on transformation function A (FIG. 8). This output signal equals the signal which is obtained by inverting the input signal. This case corresponds to a state in which the string moves in perfect tracking with the bow. In the case where the value of the input signal is less than or equal to $-X_0$, the value of transformation function A (FIG. 8) is 0. In this case, adder 536 outputs a signal which is obtained by transforming the input signal based on transformation function B (FIG. 9). The output signal of adder 536 is positive. In addition, the absolute value of the output signal decreases according to the increase of the absolute value of the input signal. In the case where the value of the input signal is more than $X_0$, the value of transformation function A (FIG. 8) is 0. In this case, adder 536 outputs a signal which is obtained by transforming the input signal based on transformation function B (FIG. 9). The output signal of adder 536 is negative. The absolute value of the output signal decreases according to the increase of the absolute value of the input signal. These cases correspond to a state in which the string moves sliding on the surface of the bow. The output signal of adder 536 is supplied to one input terminal of a multiplier 537. A bow pressure signal PB is supplied to the other input terminal of multiplier 537 by control circuit CONT when the musical tone generation is triggered. This signal PB indicates a pressure which is applied to the string by the bow. The output signal of multiplier 537 is supplied to a multiplier 538 and to low-pass filter 533 as mentioned above. Low-pass filter 533 is provided for simulating a delay between the movement of the bow and the movement of the string in response to the movement of the bow. The output signal of multiplier 537 is fed back to adder 532 via this low-pass filter. On the other hand, the output signal of multiplier 537 is multiplied by envelope signal EG2 by multiplier 538. The output signal of multiplier 537 is supplied to Junction circuit COMB as an excitation signal.

The other non-linear circuits are provided so as to generate the excitation signals which are generated by excitation mechanisms of the target non-electronic musical instrument to be simulated. In these non-linear circuits, the levels of the excitation signals generated thereby are controlled based on the corresponding envelope signals.

Figure 6:
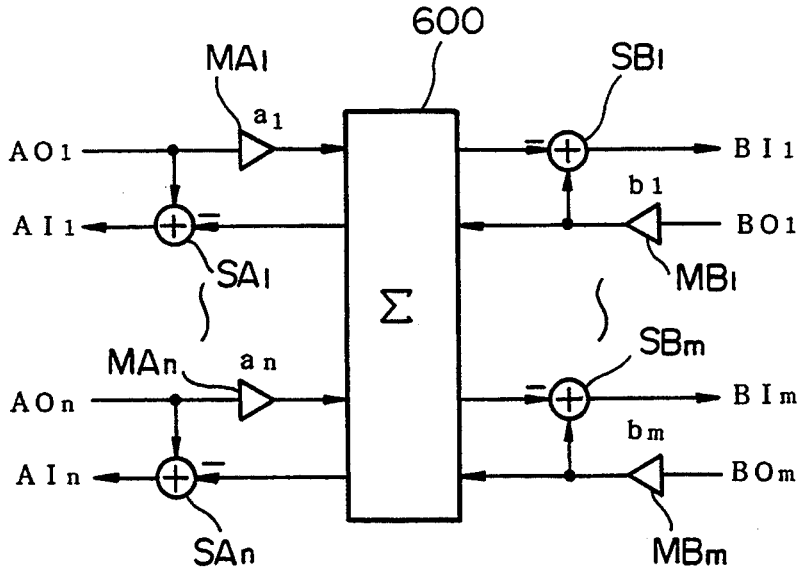
FIG. 6 is a block diagram showing the configuration of an example of a Junction circuit employed in the musical tone synthesizing apparatus of the first preferred embodiment.

Junction circuit COMB achieve a mixing function in which the output signals of the non-linear and linear circuits are mixed and a distribution function in which the mixed result is distributed for the non-linear and linear circuits by a predetermined ratio. FIG. 6 is a block diagram showing the configuration of Junction circuit COMB. In FIG. 6, 600 designates an adder; $SA_1$ through $SA_n$ and $SB_1$ through $SB_m$ designate subtractors; and $MA_1$ through $MA_n$ and $MB_1$ through $MB_m$ designate multipliers which multiply their input signals by coefficients $a_1$ through $a_n$ and $b_1$ through $b_m$. Signals $AO_1$ through $AO_n$ supplied by non-linear circuits are respectively multiplied by coefficients $a_1$ through $a_n$ by multipliers $MA_1$ through $MA_n$. Signals $BO_1$ through $BO_m$ supplied by linear circuits are respectively multiplied by coefficients $b_1$ through $b_m$ by multipliers $MB_1$ through $MB_m$. The output signals of multipliers $MA_1$ through $MA_n$ and $MB_1$ through $MB_m$ are summed by adder 600. The summation result of adder 600 is supplied to subtractors $SA_1$ through $SA_n$ and $SB_1$ through $SB_m$. Subtractors $SA_1$ through $SA_n$ subtract the summation result of adder 600 respectively by signals $AO_1$ through $AO_n$ provided by the corresponding non-linear circuits. The subtraction results of subtractors $SA_1$ through $SA_n$ are supplied to the corresponding non-linear signal processing circuits as input signals $AI_1$ through $AI_n$. Subtractors $SB_1$ through $SB_m$ subtract the summation result of adder 600 respectively by signals $BO_1$ through $BO_m$ provided by the corresponding linear signal processing circuits. The subtraction results of subtractors $SB_1$ through $SB_m$ are supplied to the corresponding linear circuits as input signals $BI_1$ through $BI_n$.

Figures 10A, 10B, 10C:
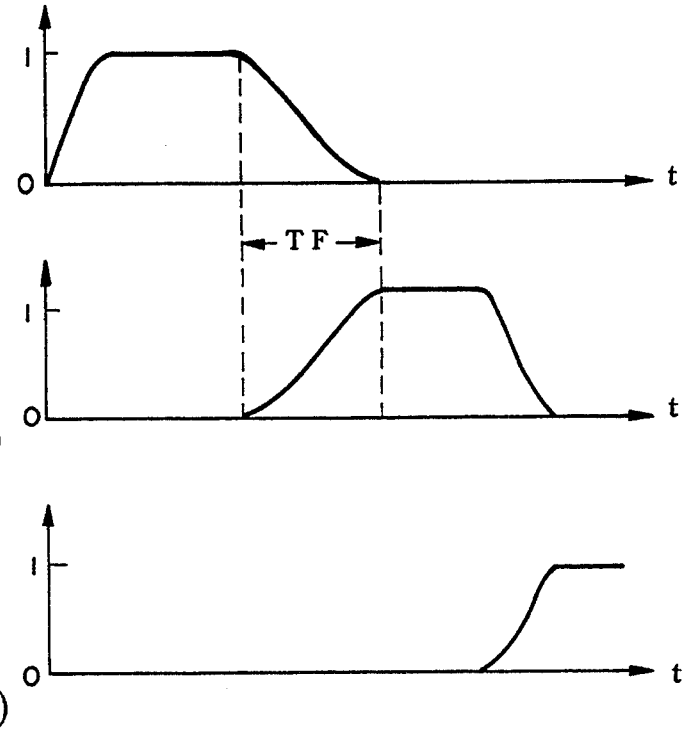
FIGS. 10(*a*) through 10(*c*) show waveforms of envelope signals genereted in the musical tone synthesizing apparatus of the first preferred embodiment.

Next, the operation of the musical tone synthesizing apparatus will be described. When a key-on event is generated by an operational means such as a key-board, a tone control parameter such as a pressure signal P, an embouchure signal E, a bow velocity signal VB and a bow pressure signal PA, which are described above, are generated based on the key-on event by control circuit CONT. These control parameters are then supplied to the corresponding non-linear signal processing circuits $NL_1$ through $NL_n$. As a result, excitation signals are generated by non-linear circuits based on the corresponding control parameters. On the other hand, envelope signals $EG_1$ through $EG_n$ are generated in response to the triggering of musical tone generation. These envelope signals are supplied to the corresponding non-linear circuits. FIG. 10 shows the examples of the waveforms of these envelope signals. In non-linear signal processing circuits, the levels of the excitation signals generated thereby and supplied to Junction circuit COMB are controlled over time based on the corresponding envelope signals. The excitation signals are mixed, and the mixing result is distributed into input signals for linear signal processing circuits $LC_1$ through $LC_m$ and for non-linear signal processing circuits $NL_1$ through $NL_n$ as described above. The signals introduced into the linear signal processing circuits circulate through the circuits, and are fed back to junction circuit COMB. On the other hand, the signals introduced into the non-linear signal processing circuits are used for generating the excitation signals. The musical tone signal is picked up from a predetermined node in the apparatus, for example the output terminal of adder 600 in junction circuit COMB. The musical tone signal is supplied to a sound system (not shown) to generate the musical tone. In the case where the envelope signals are sequentially generated, musical tones generated by various non-electronic musical instruments, are sequentially generated by the musical tone synthesizing apparatus. For example, in the case where envelope signals $EG_1$, $EG_2$ and $EG_3$ are sequentially generated as shown in FIG. 10, the excitation signal corresponding to a wind instrument is output from non-linear circuit $NL_1$ thereby generating a musical tone of the wind Instrument, after which the excitation signal corresponding to a violin is output from non-linear circuit $NL_2$ thereby generating a musical tone of the violin, after which the other kind of musical tones are sequentially synthesized. Furthermore, in the case where the rising of one envelope signal and the falling of the other envelope signal simultaneously occur, for example, the case in which during a section TF, envelope signal $EG_2$ rises while envelope signal $EG_1$ falls, the tone color of the generated musical tone is gradually varied from a musical tone of one musical instrument to a musical tone of another musical instrument.

[2] Second Preferred Embodiment

Figure 11:
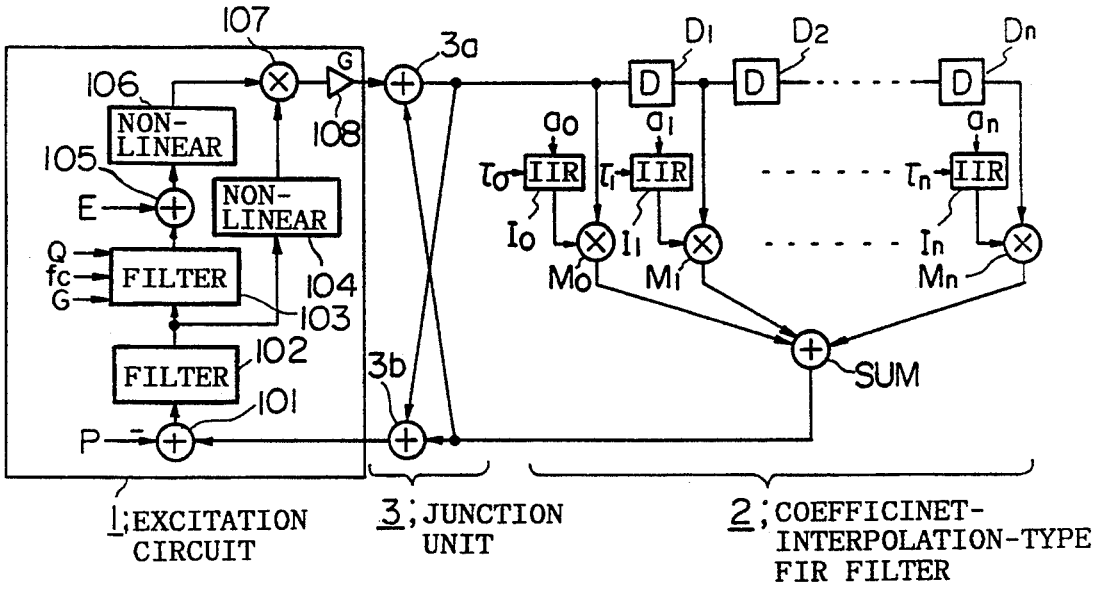
FIG. 11 is a block diagrams showing the configuration of a musical tone synthesizing apparatus of the second preferred embodiment of the present Invention.
Figure 31:
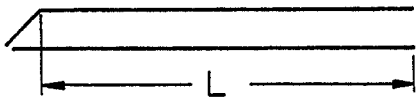
FIG. 31 shows an wind instrument having a cylindrical resonator tube.
Figure 32:
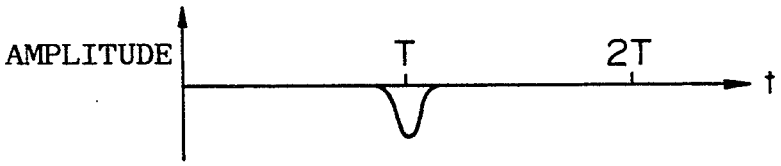
FIG. 32 shows an example of the impulse response of the cylindrical tube shown in FIG. 31.

FIG. 11 is a block diagram showing the configuration of a musical tone synthesizing apparatus of the second preferred embodiment. This apparatus is designed so as to synthesize musical tones generated by a wind instrument which has a cylindrical resonator tube such as shown in FIG. 31. In FIG. 11, 1 designates an excitation circuit which is obtained by simulating the configuration of the mouth piece of a wind instrument. 2 designate a coefficient interpolation type FIR filter which simulates the resonator tube. The coefficients used for FIR filtering achieved by FIR filter 2 are varied over time by a control circuit (not shown). The control of these coefficient will be described later. 3 designates a junction unit which simulates a combination portion of the mouth piece and resonator tube. Junction unit 3 consists of two adders 3*a* and 3*b*. The output signal of the excitation circuit is supplied to one input terminal of adder 3*a*. The output signal of adder 3*a* is supplied to FIR filter 2 and to one input terminal of adder 3*b*. The output signal of FIR filter 2 is supplied to the other input terminal of adder 3*a* and to the other input terminal of adder 3*b*. The output signal of adder 3*b* is supplied to excitation circuit 1.

In excitation circuit 1, a subtractor 101, an adder 105, a non-linear circuit 106, and multipliers 107 and 108 are provided, and which respectively correspond to subtractor 513, adder 516, non-linear circuit 517, and multipliers 518 and 519 provided in the above-described non-linear circuit shown In FIG. 4. In excitation circuit 1, filters 102 and 103 are provided instead of low-pass filter 515, and a non-linear transformation circuit 104 is provided instead of low-pass filter 514. Filter 102 is provided for adjusting a phase rotation which is generated with the signal transmission in which an input signal propagates through the excitation circuit. The output signal of filter 102 is supplied to filter 103 and non-linear circuit 104. Filter 103 is provided for simulating the dynamic response of a reed in response to the variation of the air pressure in the mouth piece, whereby the higher frequency components of the signal are rejected. A low-pass filter is preferably used as filter 103. The characteristics of filter 103 such as selectively Q, cut-off frequency fc and gain G are controlled based on control data supplied from the control circuit so as to generate a musical tone having the desired tone color. The output signal of low-pass filter 103 is supplied to adder 105 and non-linear transformation circuit 104. Non-linear transformation circuit 104 is provided for simulating a saturation phenomenon in which the velocity of the air flow passing through a mouth piece goes into saturation when the air pressure in the mouth piece becomes higher. The description for the other elements in excitation circuit 1 are omitted because their functions and the interconnection between them are the same as the configuration shown in FIG. 4.

Figure 12:
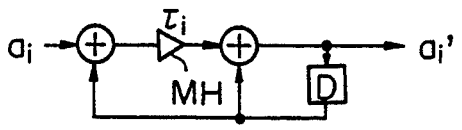
FIG. 12 shows the configuration of an example of the interpolators employed in the musical tone synthesizing apparatus of the second preferred embodiment.
Figure 13:
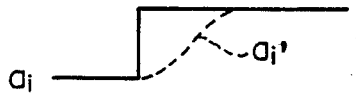
FIG. 13 shows the operation of the interpolator shown in FIG. 12.

Coefficient interpolation type FIR filter 2 provides delay circuits $D_1$ through $D_n$, multipliers $M_0$ through $M_n$, an adder SUM and interpolation circuits $I_0$ through $I_n$. The output signal of multiplier 108 in excitation circuit 1 is introduced to delay circuit $D_1$ via adder 3*a*. This signal is an excitation signal which corresponds to the air pressure wave introduced into the resonator tube of a wind instrument from the mouth piece. The excitation signal propagates through delay circuits $D_1$ through $D_n$ which are connected in a cascade manner, and have the same delay interval. The excitation signal is supplied to multiplier $M_O$. The delayed signals of the excitation signal, i.e., the output signals of delay circuits $D_1$ through $D_n$ are respectively supplied to multipliers $M_0$ through $M_n$. Interpolation circuits $I_0$ through $I_n$ are respectively provided for interpolating filtering coefficients $a_0$ through $a_n$ over time. These filtering coefficients are supplied from the control means in order to generate a musical tone having the desired tone color. IIR (Infinite Impulse Response) filters as shown in FIG. 12 are preferably used as interpolation circuits $I_0$ through $I_n$. When filtering coefficients $a_1$ (i=0 to n) are changed from an old value to a new value in a step manner as shown in FIG. 12, the output coefficient $a_I'$ of each interpolation circuit $I_i$ gradually varies from the old value to the new value according to the curve as Indicated by a broken line in FIG. 12. Time constants $\tau_i$ (i+0 to n) are set by the control circuit to interpolation circuits $I_i$ (i=0 to n) to determine the response thereof for the changing of the input filtering coefficients $a_i$ (i=0 to n). In the case where the IIR filter shown in FIG. 12 is used as the interpolation circuits, time constant $\tau_i$ is set as the multiplication coefficient for multiplier MH provided in the corresponding IIR filter. Filtering coefficients $a_i'$ (i=0 to n) output from interpolation circuits $I_i$ (i=0 to n) are supplied to multiplier $M_i$ (i=0 to n). Multiplier $M_0$ multiplies the excitation signal with filtering coefficient $a_0'$ output from interpolation circuit $I_0$. Multipliers $M_1$ through $M_n$ respectively multiply the output signals of delay circuits $D_1$ through $D_n$ with filtering coefficients $a_1'$ through $a_n'$ output from interpolation circuits $I_1$ through $I_n$. The multiplication results of multipliers $M_0$ through $M_n$ are summed by adder SUM. The summation result of adder SUM is supplied to subtractor 101 in excitation circuit 1 via adder 3*b*.

Next, the operation of the musical tone synthesizing apparatus will be described. When a desired tone color is designated by a performer through the operation of a tone color selecting means such as a tone color switch (not shown), filtering coefficients $a_0$ through $a_n$ are determined by the control circuit based on the designated tone color. Filtering coefficients $a_0$ through $a_n$ are then set respectively to multipliers $M_0$ through $M_n$ in FIR filter 2 via interpolation circuits $I_0$ through $I_n$. When the musical tone generation is triggered by operating an operational means such as a keyboard, control signals such as signals P and E are supplied from the control circuit to excitation circuit 1. This causes the generation of the excitation signal in excitation circuit 1, whereby the excitation signal is then output from excitation circuit 1. The excitation signal is supplied to FIR filter 2 via adder 3*a* of junction unit 3. The output signal of FIR filter 2 is supplied to excitation circuit 1 via adder 3*a* of Junction unit 3. The new excitation signal is then generated based on the signal supplied from FIR filter 2. Thereafter, the same operations are repeated. The signal circulates in the apparatus and is picked up as a musical tone signal.

In the case where the tone color of a musical tone to be generated is changed by the operation of a tone color switch or a change of the tone pitch of the musical tone during generation of a musical tone signal, filtering coefficients $a_0$ through $a_n$ are changed to new values corresponding to the new tone color. New filtering coefficients $a_i$ (i=0 to n) supplied to multipliers $M_i$ (i=0 to n) are supplied to interpolation circuit $I_i$ (i=0 to n) and are thereby interpolated. The interpolated filtering coefficients $a_i$ (i=0 to n) are supplied from interpolation circuits $I_i$ (i=0 to n) to multipliers $M_i$ (i=0 to n). In this manner, the filtering coefficients for the multipliers are gradually varied from the values corresponding to the old tone color to the values corresponding to the new tone color. As a result, the tone color of the musical tone generated by the apparatus smoothly varies from the old tone color to the new tone color without the generation of a click noise.

[3] Third Preferred Embodiment

Figure 14:
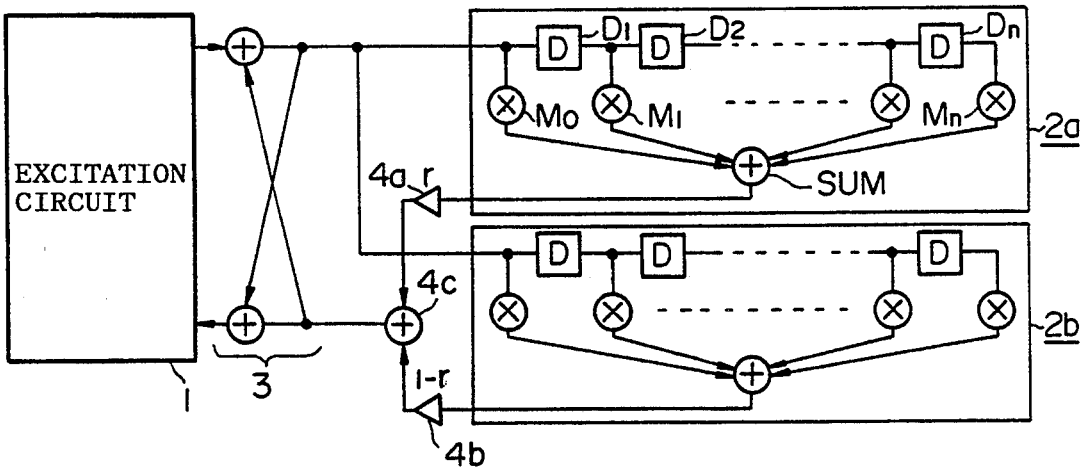
FIG. 14 is a block diagram showing the configuration of the musical tone synthesizing apparatus of the third preferred embodiment of the present invention.

FIG. 14 is a block diagram showing the configuration of the musical tone synthesizing apparatus of the third preferred embodiment. This apparatus is also designed so as to synthesize musical tones which are generated by a wind instrument having a cylindrical resonator tube. In FIG. 14, 2*a* and 2*b* designate FIR filters having a configuration which is obtained by rejecting interpolating circuits $I_0$ through $I_n$ from coefficient interpolation type FIR filter 2. In FIR filters 2*a* and 2*b*, filtering coefficients $a_0$ through $a_n$ generated by a control circuit (not shown) are directly set to multipliers $M_0$ through $M_n$. The excitation signal generated by excitation circuit 1 is supplied to both FIR filters 2*a* and 2*b* via junction unit 3. The output signals of FIR filters 2*a* and 2*b* are respectively multiplied by coefficients r and 1−r by multipliers 4*a* and 4*b*. The multiplication results of multipliers 4*a* and 4*b* are summed by adder 4*c*. The output signal of adder 4*c* is supplied to excitation circuit 1 via junction unit 3. The filtering coefficients for FIR filters 2*a* and 2*b*, and coefficients r and 1−r for multipliers 4*a* and 4*b* are controlled by the control means.

Next, the operation of the musical tone synthesizing apparatus will be described. In the case where the designation of the tone color is not changed during musical tone generation, a value of r is fixed to 0 or 1. In the case where r=0, the excitation signal from excitation circuit 1 is supplied to both FIR filters 2*a* and 2*b* but only the output signal of FIR filter 2*b* is supplied to excitation circuit 1 via multiplier 4*b* and Junction unit 3. That is, only FIR filter 2*b* is used for controlling the tone color. When a new tone color is designated during the generation of a musical tone when the condition is r=0, filtering coefficients corresponding to the new tone color are determined and set to FIR filter 2a by control means. At this time, the output signal of FIR filter 2a is not supplied to excitation circuit 1 because r=0. After the filtering coefficients are set to FIR filter 2a, coefficient r for multiplier 4a is gradually varied from 0 to 1, while coefficient 1−r for multiplier 4b is gradually varied from 1 to 0. As a result, the level of the signal supplied from FIR filter 2b to excitation circuit 1 gradually decreases, while the level of the signal supplied from FIR filter 2a to excitation circuit 1 gradually increases in response to the increase in r. When r becomes 1 at last, only the output signal of FIR filter 2a is supplied to excitation circuit 1. In this manner, the signal transmission path in the apparatus is gradually changed from the old state in which the output signal of FIR filter 2b is used for tone generation, to the new state in which the output signal of FIR filter 2a is used for tone generation In response to the change of the designated tone color. When the designated tone color is changed again, filtering coefficients corresponding to the new tone color are set to FIR filter 2b, and r is gradually varied from 1 to 0. In this case, an operation similar to the above-described operation is achieved.

Figure 15:
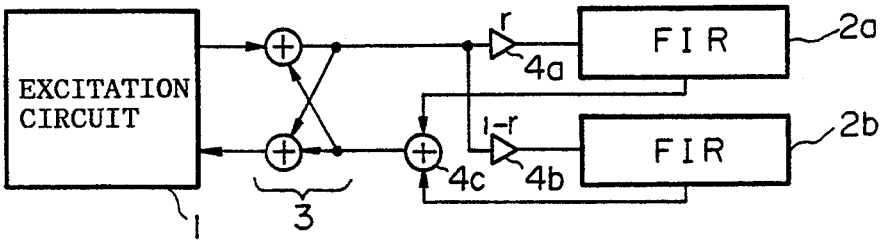
FIG. 15 is a block diagram showing the configuration of the musical tone synthesizing apparatus of the modified embodiment of the third preferred embodiment.

FIG. 15 shows a modified example of the third preferred embodiment. In the apparatus shown in FIG. 15, multipliers 4a and 4b are respectively moved to the input portions of FIR filters 2a and 2b. These multipliers are provided as a distribution circuits which distributes an input signal for FIR filters 2a and 2b. In this configuration, the same operation obtained in the configuration of FIG. 14 can be obtained.

[4] Fourth Preferred Embodiment

Figure 16:
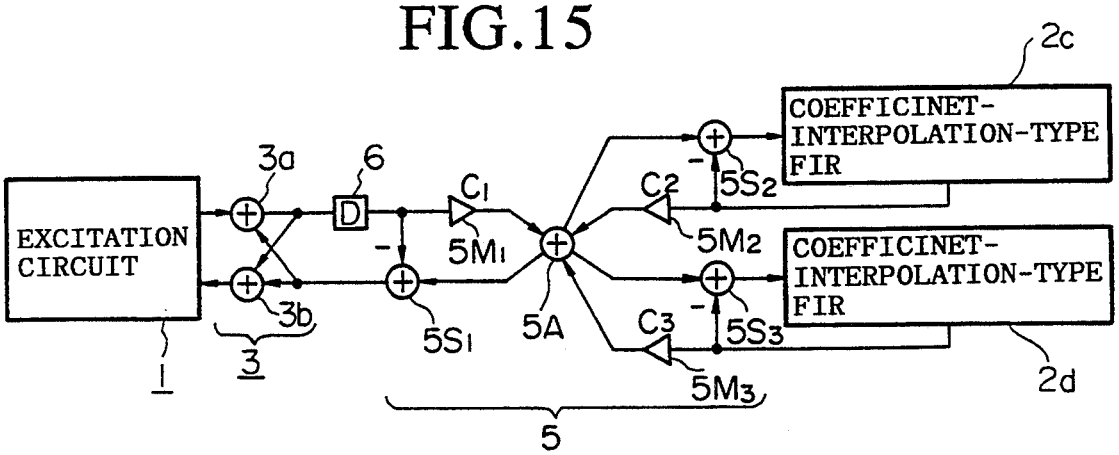
FIG. 16 is a block diagram showing the configuration of the musical tone synthesizing apparatus of the fourth preferred embodiment of the present invention.

FIG. 16 is a block diagram showing a configuration of a musical tone synthesizing apparatus of the fourth preferred embodiment. This apparatus is designed to generate musical tones which are generated by a wind instrument having a conical resonator tube as shown in FIG. 33.

Figure 33:
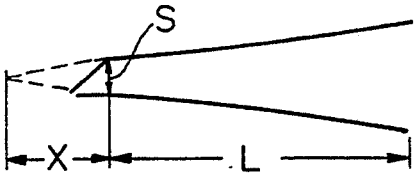
FIG. 33 shows a wind instrument having a conical resonator tube.
Figure 34:
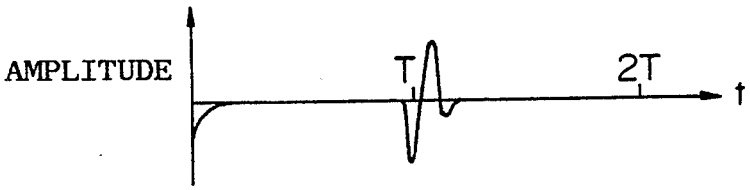
FIG. 34 shows an example of the impulse response of the conical tube shown in FIG. 33.
Figure 35:
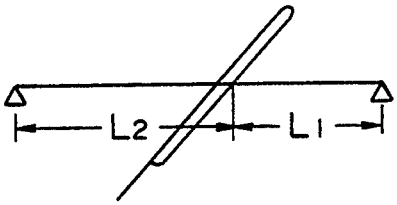
FIG. 35 shows a bowed string instrument.
Figure 36A:
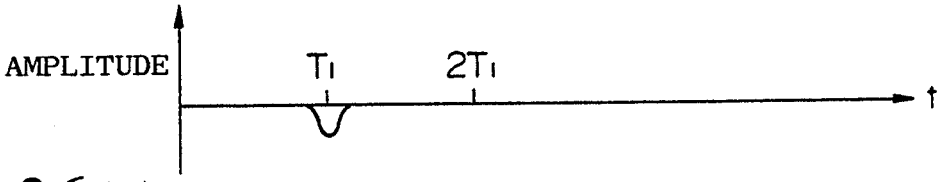
FIGS. 36(*a*) and 36(*b*) show an example of the impulse response of the string shown in FIG. 35.
Figure 36B:
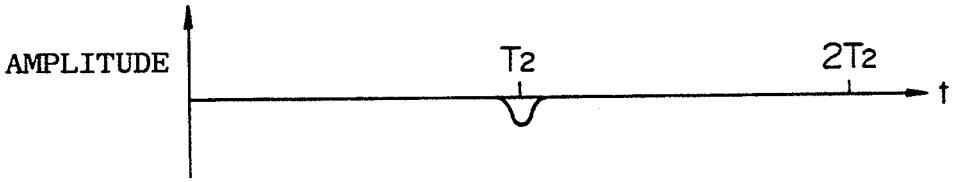
Figure 37:
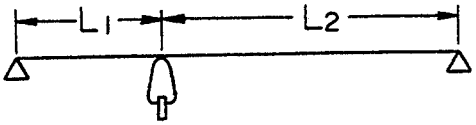
FIG. 37 shows a struck string instrument.
Figure 38A:
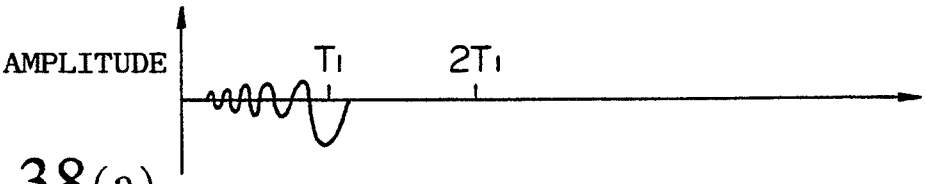
FIGS. 38(*a*) and 38(*b*) show an example of the impulse response of the string shown in FIG. 37.
Figure 38B:
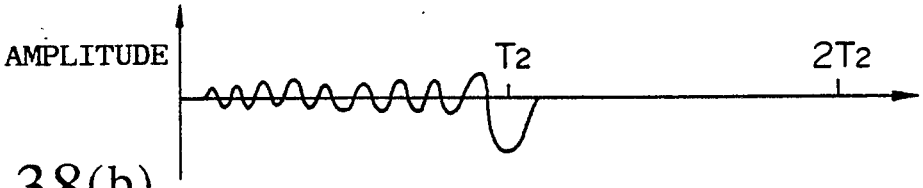

Input acoustic impedance Z of a conical resonator tube such as shown in FIG. 33 can be defined by the following equation:

$$Z = j*\pi*c*k*X*\sin(k*L)/[S\{\sin(k*L) + k*X*\cos(k*L)\}] = 1/[\{S/(j*\pi*c*k*X)\} + \{S/(j*\pi*c*\tan(k*L))] \quad (1)$$

where $\pi$ is the density [g/cm$^3$] of the medium in the resonator tube through which sound wave propagates; c is the velocity [cm/sec] of the sound wave; X is a depth [cm] of the throat of a performer who holds the mouth piece of the wind instrument; k is a wave coefficient [rad/cm] which is defined as k=2λ (λ is a wavelength [cm] of the sound wave; and S is a sectional area of the terminal portion of the conical resonator tube which is connected to the mouth piece.

In the above equation, the following equations are defined with respect to the first and second items of the denominator:

First item→

$$\begin{aligned} Z_x &= (j*\rho*c*k*X)/S \\ &= (j*\omega*\rho*S*X)/S^2 \\ &= (j*\omega*m)/S^2 \\ &= j*\omega*M \end{aligned} \quad (2)$$

Second item→

$$ZL=(j,\rho*c*\tan(k*L))/S \quad (3)$$

In the above equation (2), ω is the angular frequency [rad/sec] of the sound wave which is written as ω=c*k. M is inertia which is determined as M=ρ. The above equation (1) can be rewritten as the following equation by using equations (2) and (3):

$$1/Z=(1/Z_X)+(1/Z_L) \quad (4)$$

The above equation (4) shows that input acoustic impedance Z of the conical resonator tube can be regard as a impedance of a circuit in which a device having an impedance $Z_X$ and a device having an impedance $Z_L$ are connected in a parallel manner. In the case where the output terminal of a lossless waveguide, the length of which is L, is shorted, the input impedance Zi of the waveguide at the input terminal is determined as $Z_i$=j*tan(k*L). Such an waveguide is used for simulating the transmission function of a cylindrical resonator tube which has a constant diameter. In addition, in the case where depth X of the throat is short, impedance $Z_X$ defined by the equation (2) is approximated by the following equation:

$$Z_X \approx \{j*\rho*c*\tan(k*X)\}/S \quad (5)$$

Impedance $Z_X$ defined by equation (5) also can be regarded as the input impedance of a lossless waveguide corresponding to a cylindrical resonator tube. Accordingly, a conical resonator tube can be replaced by two cylindrical resonator tubes, the input terminals of which are connected to each other.

In FIG. 16, coefficient interpolation type FIR filters 2c and 2d are provided. These FIR filters correspond to two cylindrical resonator tubes which simulate a conical resonator tube. The coefficient interpolation type FIR filter employed in the second preferred embodiment (FIG. 11) can be used as FIR filters 2c and 2d. The filtering coefficients corresponding to the desired tone color are set to FIR filter 2c and 2d.

Junction unit 5 is provided for the Interface of the signal transmission between excitation circuit 1, FIR filters 2c and 2d. Junction unit 5 provides multipliers 5M$_1$ through 5M$_3$, subtractors 5S$_1$ through 5S$_3$ and an adder 5A. Adder 5A sums the output signals of multipliers $C_1$, $C_2$ and $C_3$. The summation result of adder 5A is output to subtractors 5S$_1$, 5S$_2$ and 5S$_3$. Subtractor 5S$_1$ subtracts the output signal of a one sample period delay circuit 6 from the output signal of adder 5A. The output signal of subtractor 5S$_1$ is supplied to excitation circuit 1 via Junction unit 3. One sample period delay circuit 6 delays the excitation signal supplied from excitation circuit 1 via junction unit 3 by one sample period. This one sample period delay circuit is inserted so that a loop including adder 3a of junction unit 3 and subtractor 5S$_1$ of junction unit 5 does not form a delay-free loop in which no delay element is included therein. Multiplier $5M_1$ multiplies the output signal of one sample period delay circuit 6 by coefficient $C_1$. The multiplication result of multiplier $5M_1$ is then supplied to adder 5A. Subtractor $5S_2$ subtracts the output signal of FIR filter *2c* from the output signal of adder 5A. The subtraction result of subtractor $5S_2$ is supplied to FIR filter *2c*. Multiplier $5M_2$ multiplies the output signal of FIR filter *2c* by a coefficient $C_2$. The multiplication result of multiplier $5M_2$ is then supplied to adder 5A. Subtractor $5S_3$ subtract the output signal of FIR filter *2d* from the output signal of adder 5A. The subtraction result of subtractor $5S_3$ is supplied to FIR filter *2d*. Multiplier $5M_3$ multiplies the output signal of FIR filter *2d* by a coefficient $C_3$. The multiplication result of multiplier $5M_3$ is then supplied to adder 5A. Coefficients $C_1$. $C_2$ and $C_3$ are determined so that these coefficients satisfy a condition of $C1+C2+C3 \lesssim 2$ and correspond to the form of the conical resonator tube to be simulated.

In the musical tone synthesizing apparatus, the filtering coefficients for the filtering operations of FIR filters *2c* and *2d* are interpolated over time in the case where the filtering coefficients are changed in order to change the tone color of the musical tone to be generated in a manner as similar to the manner which is achieved in the second preferred embodiment. Accordingly, the tone color can be smoothly varied from the old tone color to the new tone color without generating a click noise.

The above-described preferred embodiments can be applied for simulating the musical tone generation of a wind instrument having a tone hole. When changing the tone pitch of the generated musical tone, the performer operates the tone holes provided in a wind instrument. In the case where a tone hole is changed from an on-state to an off-state or from an off-state to an on-state in order to change the tone pitch, the tone color of the generated musical tone is varied. In a musical tone synthesizing apparatus simulating a wind instrument, a FIR filter is provided as a tone color control means in order to simulate the above phenomenon. The present invention can be preferably applied to the tone color control in such a musical tone synthesizing apparatus. In this case, the filtering coefficients for the filtering operation of the FIR filter are interpolated over time. As a result, the tone color of the generated musical tone is gradually varied from the old tone color corresponding to the old state of the tone hole to the new tone color corresponding to the new state of the tone hole without generating a click noise. In the case where a tone hole is incompletely closed, the acoustic loss in the resonator tube increases. As a result, the amplitude and pitch of the generated musical tone become unstable. Such a phenomenon can be simulated by using the above tone color control.

[5] Fifth Preferred Embodiment

Figure 17:
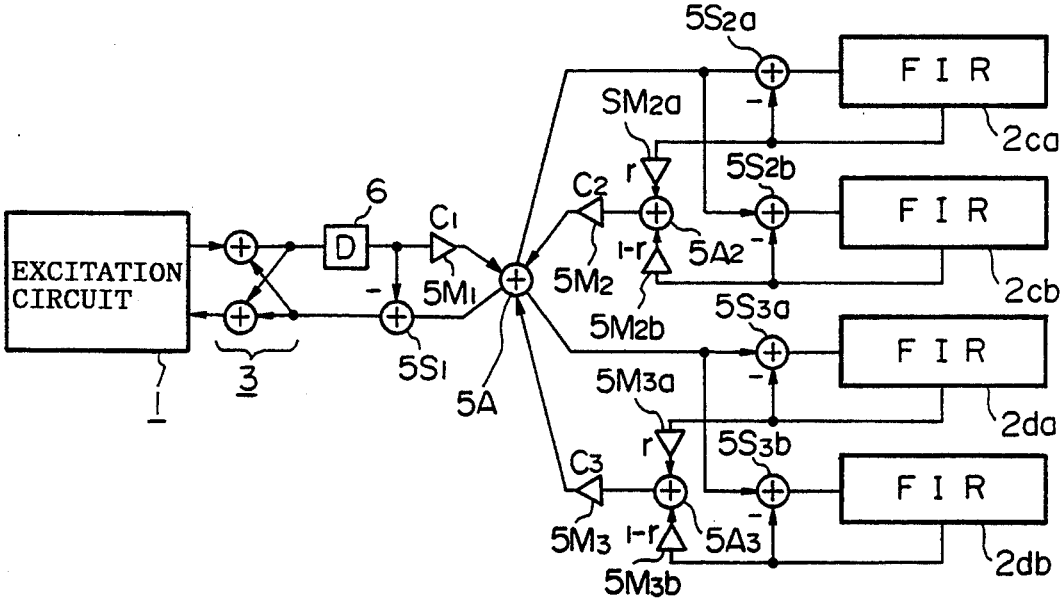
FIG. 17 is a block diagram showing the configuration of the musical tone synthesizing apparatus of the fifth preferred embodiment of the present invention.

FIG. 17 is a block diagram showing a musical tone synthesizing apparatus of the fifth preferred embodiment. This apparatus is designed so as to generate the musical tones which are generated by a wind instrument having a conical resonator tube. In this apparatus, FIR filters *2ca*, *2cb*, *2da* and *2db* are provided which have the same configuration as shown in FIG. 14 and which include no interpolation circuit. Subtractor $5S_{2a}$, $5S_{2b}$, $5S_{3a}$ and $5S_{3b}$ are provided which respectively subtract the output signals of FIR filters *2ca*, *2cb*, *2da* and *2db* from the output signals of adder 5A. The subtraction results of subtractors $5S_{2a}$, $5S_{2b}$, $5S_{3a}$ and $5S_{3b}$ are respectively supplied to FIR filters *2ca*, *2cb*, *2da* and *2db*. Multiplier $5M_{2a}$ multiplies the output signal of FIR filter *2ca* by a coefficient r. Multiplier $5M_{2b}$ multiplies the output signal of FIR filter *2cb* by a coefficient $1-r$. Adder $5A_2$ sums the multiplication results of multipliers $5M_{2a}$ and $5M_{2b}$. Multipliers $5M_{2a}$, $5M_{2b}$ and adder $5A_2$ constitute a mixing circuit which mixes the output signals of FIR filters *2ca* and *2cb*. The mixing result, i.e., the output signal of adder $5A_2$ is supplied to multiplier $5M_2$. A mixing circuit for FIR filters *2da* and *2db* is also provided which have multipliers $5M_{3a}$, $5M_{3b}$ and an adder $5A_3$. This mixing circuit have the same configuration as the above-described mixing circuit for FIR filters *2ca* and *2cb*. The mixing result, i.e., the output signal of adder $5A_3$ is supplied to multiplier $5M_3$. The other portions of this apparatus are the same as the configuration as shown in FIG. 16.

In the musical tone synthesizing apparatus, the operation for changing the tone color is achieved in a manner similar to that in the above-described third preferred embodiment. In the case where the tone color of a generated musical tone is changed during the period at which $r=0$ and the musical tone is being generated, the filtering coefficients corresponding to the new tone color are set to FIR filter *2ca* and *2da*, after which coefficient r is gradually varied from 0 to 1. In contrast, in the case where the tone color of the generated musical tone is changed during the period at which $r=1$ and the musical tone is being generated, the filtering coefficients corresponding to the new tone color are set to FIR filter *2cb* and *2db*, after which coefficient r is gradually varied from 1 to 0. As a result, the tone color of the generated musical tone is gradually varied from the old tone color to the new tone color without generating a click noise.

Multipliers $5M_{2a}$, $5M_{2b}$, $5M_{3a}$ and $5M_{3b}$ may be respectively provided in front of subtractors $5S_{2a}$, $5S_{2b}$, $5S_{3a}$ and $5S_{3b}$. In this modified configuration, an operation which is essentially equal to the above-described operation is carried out.

[6] Sixth Preferred Embodiment

Figure 18:
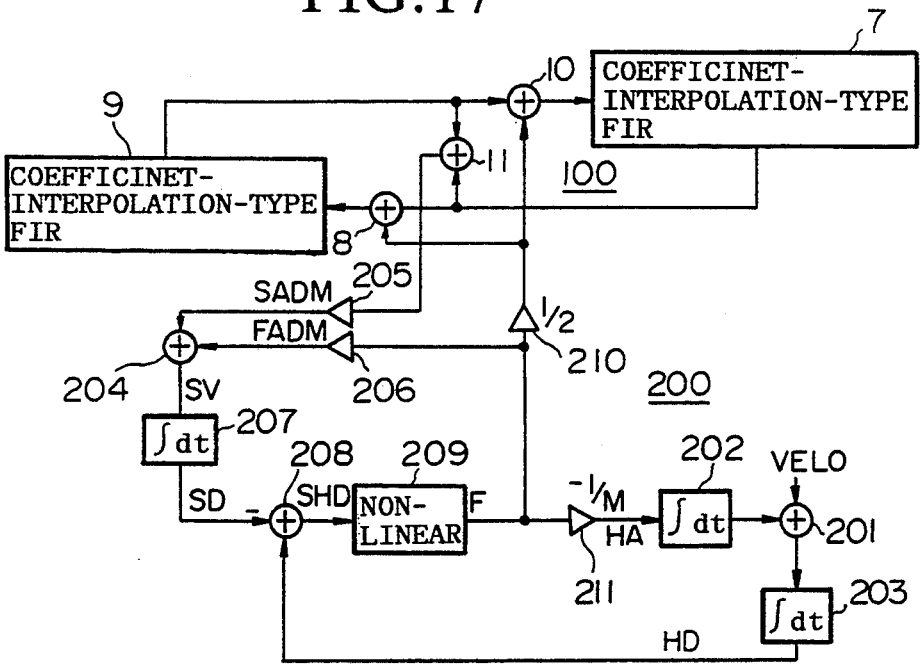
FIG. 18 is a block diagram showing the configuration of the musical tone synthesizing apparatus of the sixth preferred embodiment of the present invention.

FIG. 18 is a block diagram showing the configuration of a musical tone synthesizing apparatus of the sixth preferred embodiment. This apparatus is designed so as to synthesize musical tones which are generated by struck-string instruments, such as a piano. A coefficient-interpolation-type FIR filter 7, an adder 8, a coefficient-interpolation-type FIR filter 9 and an adder 10 are provided so as to form a closed-loop. These are provided for simulating the operation of a string of a piano. More specifically. FIR filter 7 is provided for simulating the impulse response of a part of the string between the struck point of the sting and the bridge at which one terminal of the string is fixed. FIR filter 7 Is provided for simulating the impulse response of the other part of the string between the struck point and the capotasto at which the the other terminal of the string is fixed. These FIR filters have a same configuration as the FIR filter employed in the above-described second preferred embodiment. The filtering coefficients used for the filtering operation of FIR filters 7 and 9 are set by control means (not shown). The output signals of FIR filters 7 and 9 are summed by an adder 11.

An excitation circuit 200 is provided for simulating an excitation operation which is operated by the hammer on the string. A hammer velocity signal VEL0 is supplied to one input terminal of adder 201. This signal indicates the velocity of the hammer which comes into contact with the string. Hammer velocity signal VEL0 is determined by the control means based on an operational parameter such as a key-on touch detected from a key-board (not shown). On the other hand, a value integrated in an integrator 202 is supplied to the other Input terminal of adder 201. This value indicates the variation of the velocity of the hammer which is generated based on the interaction between the hammer and the string. The operation simulating this interaction will be described later. Adder 201 outputs a signal which corresponds to the velocity of the hammer. The output signal of adder 201 is integrated in an integrator 203. The integrated value in integrator 203 corresponds to the displacement of the hammer and is output from integrator 203 as a hammer displacement signal HD. On the other hand, the output signal of 11 is multiplied by a coefficient SADM by multiplier 205. The output signals of multiplier 205 and a multiplier 206 are summed by adder 204. The output signal of multiplier 205 corresponds to the velocity of the string at the struck point. The output signal of multiplier 206 corresponds to the variation of the velocity of the string which is generated based on the Interaction between the hammer and the string. Accordingly, the summation result of adder 204 corresponds to the new velocity of the string which is varied from the previous velocity based on the interaction between the hammer and the string. The summation result of adder 204 is output therefrom as a string velocity signal SV. String velocity signal SV is Integrated in an integrator 207 to generate a string displacement signal SD corresponding to the displacement of the string. Subtractor 208 subtracts string velocity signal SD from hammer velocity signal HD to generate a relational displacement signal SHD which corresponds to the depth in which the string goes into the hammer.

The relational displacement signal SHD is transformed into a repulsive signal F by non-linear transformation circuit 209. Repulsive force signal F indicates the repulsive force which is generated between the string and the hammer. Repulsive force signal F is multiplied by ½ by multiplier 210. This multiplication result F/2 is returned to adders 8 and 10 in loop circuit 100. This signal F/2 corresponds to the velocity components of the vibration waves which propagate toward both sides of the string via the struck point. On the other hand, the output signal of non-linear transformation circuit 209 is multiplied by a predetermined coefficient FADM by multiplier 206 to generate the above-described signal corresponding to the variation of the velocity of the string.

In the musical tone synthesizing apparatus, when the tone color of the synthesized musical tone is changed, the filtering coefficients used for the filtering operation of FIR filters 7 and 9 are interpolated over time. As a result, the changing of the tone color is smoothly achieved without the generation of a click noise.

[7] Seventh Preferred Embodiment

Figure 19:
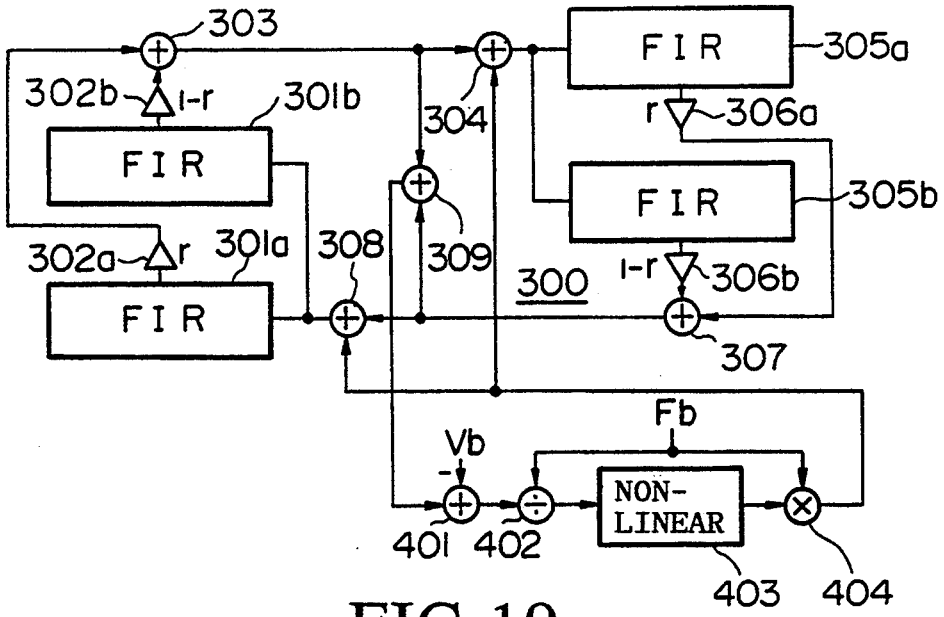
FIG. 19 is a block diagram showing the configuration of the musical tone synthesizing apparatus of the seventh preferred embodiment of the present invention.

FIG. 19 is a block-diagram showing the configuration of a musical tone synthesizing apparatus of the seventh preferred embodiment. This apparatus is designed so as to synthesize musical tones generated by bowed string instruments such as a violin. FIR filters 301*a* and 301*b* are provided for simulating the impulse response of the part of the string between the bowed point of the string and a nut at which the terminal portion of the string is fixed. The output signals of FIR filters 301*a* and 301*b* are respectively multiplied by coefficients r and 1−r by multipliers 302*a* and 302*b*. The multiplication results of multipliers 302*a* and 302*b* are summed by adder 303. The output signal of adder 303 is supplied to one input terminal of adder 304.

FIR filters 305*a* and 305*b* are provided for simulating the impulse response of the remaining part of the string between the bowed point and the bridge at which the other terminal portion of the string is fixed. The output signal of adder 304 is input to these FIR filters. The output signals of FIR filters 305*a* and 305*b* are respectively multiplied by coefficients r and 1−r by multipliers 306*a* and 306*b*. The multiplicated results of multipliers 302*a* and 302*b* are summed by adder 307. The output signal of adder 307 is supplied to one input terminal of adder 307. The output signal of adder 307 is input to FIR filters 301*a* and 301*b*. The above-described elements constitute a loop circuit 300 for simulating the operation of the string.

Figure 20:
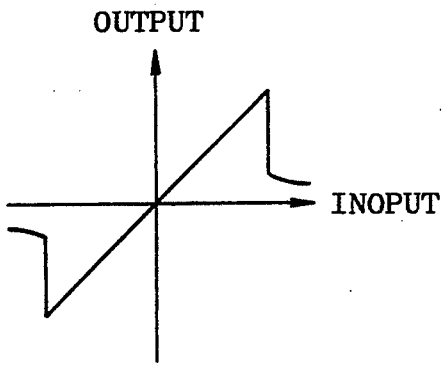
FIG. 20 shows the input-output transformation characteristics of the non-linear transformation function used in the seventh preferred embodiment.

Adder 309 sums the output signals of adder 303 and 307, and outputs the summation result which corresponds to the velocity of the string at the bowed point. Subtractor 401 subtracts a signal Vb from the output signal of adder 309. Signal Vb corresponds to the velocity of a bow driven by a performer, and is supplied by the control means. Subtractor 401 outputs the subtracted result corresponding to the relational velocity between the bow and string. The output signal of subtractor 401 is divided by a signal Fb by a divider 402. Signal Fb corresponds to the pressure applied by the bow to the string. The output signal of divider 402 is supplied to non-linear transformation circuit 403. This transformation circuit is provided for simulating the response of the string driven by the bow, and has an input-output transformation characteristic shown in FIG. 20. The output signal of non-linear transformation circuit 403 is multiplied by signal Fb by multiplier 404. Multiplier 404 outputs the multiplicated result as the output signal. This output signal corresponds to the variation of the velocity of the string which is generated based on the interaction between the bow and string. The output signal of multiplier 404 is fed back to the other input terminals of adders 303 and 307. The above-described elements constitute a excitation circuit which simulates an excitation operation performed by the bow and string.

In the above-described musical tone synthesizing apparatus, when the tone color of the synthesized musical tone is changed, the filtering coefficients used for the filtering operation of FIR filters 301*a* and 305*a* or 301*b* and 301*b* are set based on the new tone color, after which coefficient r is gradually varied from 0 to 1 or from 1 to 0 so that the musical tone having the old tone color gradually attenuates and the musical tone having the new tone color gradually increases. As a result, the changing of the tone color is smoothly achieved without generation of a click noise.

[8] Eighth Preferred Embodiment

Figure 21:
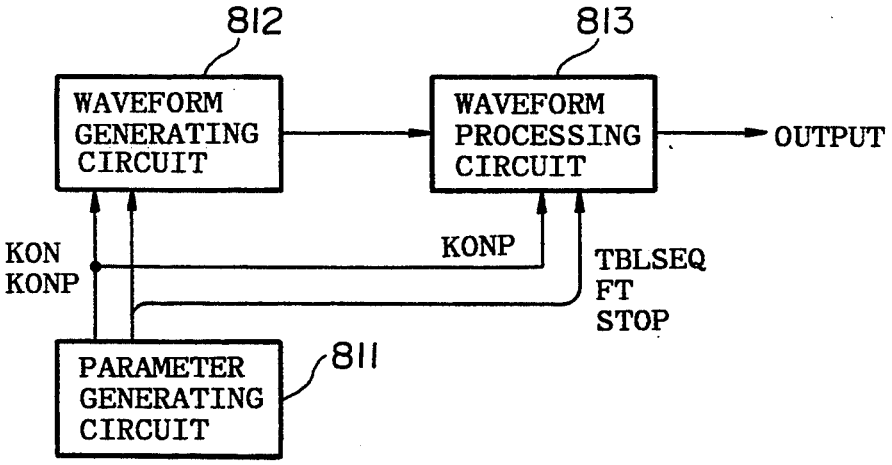
FIG. 21 is a block diagram showing the configuration of the musical tone synthesizing apparatus of the eighth preferred embodiment of the present invention.
Figure 22A:
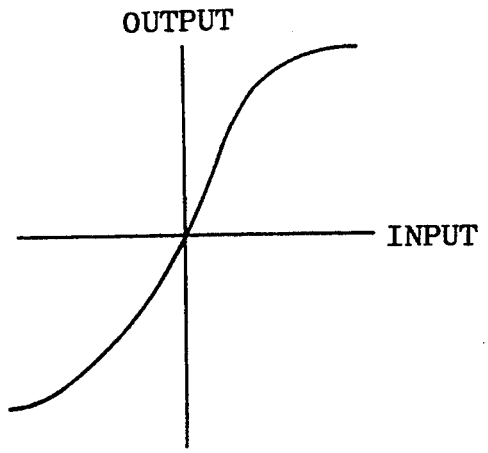
FIGS. 22(*a*) through 22(*c*) show the variation of the non-linear transformation function applied to the waveform data by a waveform processing circuit employed in the musical tone synthesizing apparatus of the eighth preferred embodiment.
Figure 22B:
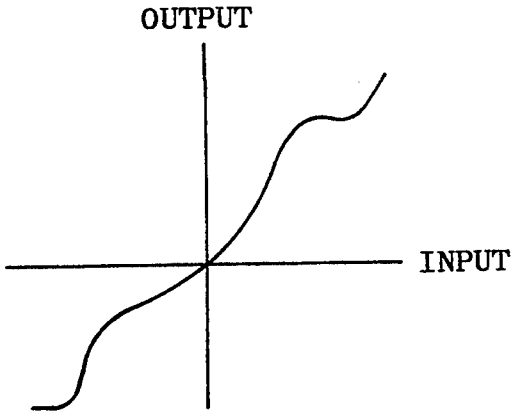
Figure 22C:
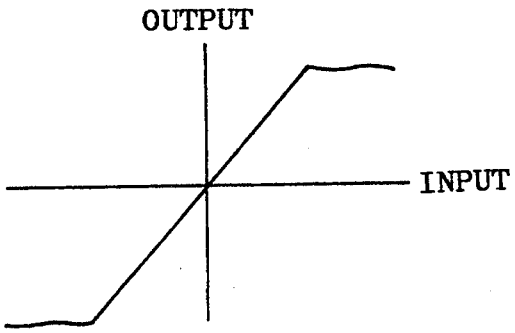

Next, a description will be given with respect to the eighth preferred embodiment of the present invention. This embodiment relates to an improvement in the control of a non-linear transformation for the tone color control. FIG. 21 is a block diagram showing the configuration of the musical tone synthesizing apparatus of the preferred embodiment. In FIG. 21, 811 designates a parameter generating circuit which generates control parameters for controlling the musical tone generation of this apparatus in response to the operation applied to a operational means such as a keyboard (not shown). A key-on signal KON, a key-on pulse KONP, a table sequence selection signal TBLSEQ, a frame time sequence selection signal FT, a count stop signal STOP and musical tone parameters are generated by control signal generating circuit 811 as control signals. A waveform generating circuit 812 generates waveforms based on the musical tone parameter, key-on signal KON and key-on pulse KONP. Key-on pulse KONP has a predetermined pulse width and is generated when any key on the keyboard is depressed. Key-on signal KON is generated while the key is being depressed. Waveform generating circuit 812 starts to generate the waveform designated by the musical tone parameter when key-on pulse KONP is generated, and maintains the generation of the waveform while key-on signal KON is being generated. A waveform processing circuit 813 is provided for modulating the waveform supplied from waveform generating circuit 812. This waveform processing circuit achieves a time-varying non-linear transformation in which the input waveform data is transformed by a non-linear transformation function the shape of which gradually varies over time. FIGS. 22(*a*) through 22(*c*) show examples of non-linear transformation function which are used for the transformation of the waveform data. When key-on pulse KONP is generated, the input waveform data are transformed to output waveform data according to the non-linear transformation function shown in FIG. 22(*a*). The shape of the non-linear function used for the transformation is gradually varied from the shape shown in FIG. 22(*a*) to the shape shown in FIG. 22(*c*) via the shape shown in FIG. 22(*b*). Signals KONP, TBLSEQ, FT and STOP are used for controlling the variation of the shape of the non-linear transformation function applied to the input waveform data.

Figure 23:
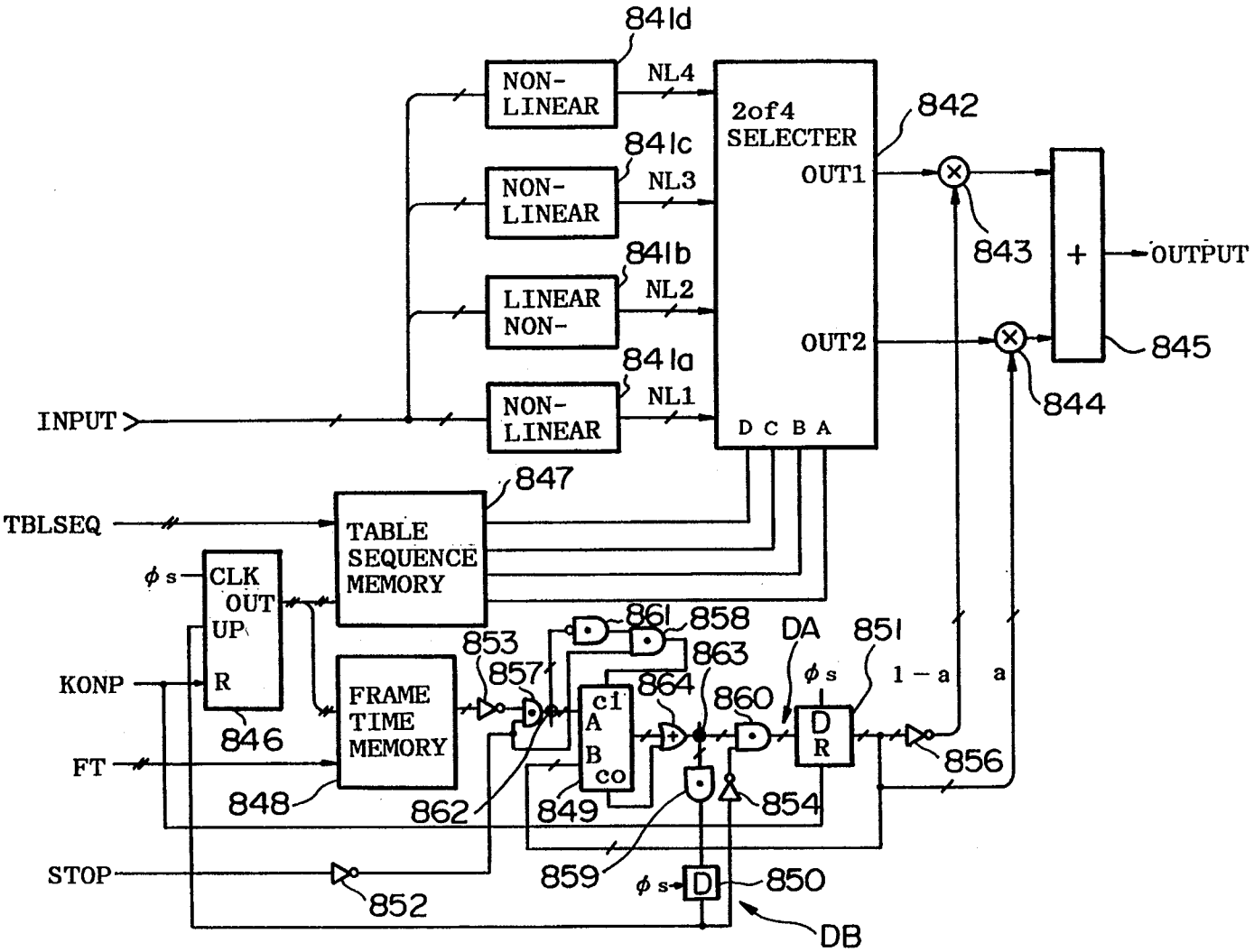
FIG. 23 is a block-diagram showing the configuration of an example of the waveform processing circuit shown in FIG. 21.

FIG. 23 shows an example of waveform processing circuit 813. In FIG. 23, 841*a* through 841d designate ROMs which store non-linear function tables. The input waveform data are applied to these ROMs as a read-out address. 842 designates a selector which selects two of the output data of ROMs 841*a* through 841*d* based on select data read-out from a table sequence memory 847. The two output data of selector 842 are supplied to multipliers 843 and 844, and thereby multiplied by weight coefficients 1−a and a. The description for these coefficients will be given later. The multiplication results of multipliers 843 and 844 are added together by adder 845. The added result of adder 845 is output as the output data of this waveform processing circuit.

846 designates a sequence counter. The count of counter 846 is reset when key-on pulse KONP is input thereto. Sequence counter 846 counts clock $\phi$s generated at a predetermined interval in the case where the level of signal DB output from a flip-flop 850 is "1". Table sequence memory 847 stores a plurality of sequence tables, each providing a series of table selection data which designate two non-linear transformation tables to be selected by selector 842. One of the sequence tables is selected based on table sequence selection signal TBLSEQ which is generated by parameter generating circuit 811 shown in FIG. 21 based on the kind of musical tone to be synthesized. The table selection data in the selected sequence table are sequentially read out according to the count of sequence counter 846. The read out data of table sequence memory 847 are sequentially supplied to selector 842. Frame time memory 848 stores a plurality of frame time tables, each providing a series of frame time data which are used for controlling the velocity of the variation of the non-linear transformation function which is applied to the input waveform data. One of the frame data tables is selected based on frame table selection signal FT which is generated by the parameter generating circuit 811. The frame time data in the selected frame time table are sequentially read out according to the count of sequence counter 846. The read out frame time data is inverted by inverter 853, and then supplied to the one input terminal of an AND gate 857. An inverter 852 inverts count stop signal STOP. The output signal of inverter 852 is supplied to the other input terminal of AND gate 857. In the case where STOP="0", AND gate 857 outputs the output signal of inverter 853, i.e., the data obtained by Inverting the read out frame time data. In the case where STOP="0", AND gate 857 outputs [0], i.e., a value, all bits of which are "0". An AND gate 861 outputs "1" in the case where all bits of the output signal of AND gate 857 are "0". In the case where any bit of the output; signal of AND gate 857 is "1", AND gate 861 outputs "0". AND gate 858 outputs "1" in the case where STOP="0" and the output signal of AND gate 861 Is "1". In the case where STOP="0" or the output signal of AND gate 861 is "0", AND gate 858 outputs "0". The output signal of AND gate 858 is supplied to the carry input terminal of an adder 849. Adder 849 adds the output signal of AND gate 857 supplied as an input value A and an output signal of a flip-flop 851 supplied as an input value B. In the case where the added result is overflow, adder 849 outputs a carry-out signal having a value "1". The addition result A+B and the carry-out signal of adder 849 are supplied to an OR gate 864. OR gate 864 outputs the added result A+B of adder 849 in the case where the carry-out signal is "0". In the case where the carry-out signal is "1", OR gate 864 outputs a signal, all bits of which are "1". An AND gate 859 outputs "1" in the case where all bits of the output signal of OR gate 864 are "1". The output signal of AND gate 859 is delayed by flip-flop 850 which samples the input signal thereto in synchronization with clock $\phi$s. The output signal DB of flip-flop 850 is supplied to sequence counter 846 as described above. Signal DB is further supplied to inverter 854. An adder 860 outputs the output signal of OR gate 864 as an output signal DA in the case where the output signal of inverter 854 is "1". In the case where the output signal of inverter 854 is "0", AND gate 860 outputs a signal, all bits of which are "0". Signal DA output from AND gate 860 is written in flip-flop 851 in synchronization with clock $\phi$s. This flip-flop is reset in the case where key-on pulse KONP is supplied thereto. The output signal of flip-flop 851 is fed-back to adder 849 as described above. In the above-described elements, adder 849 and flip-flop 851 constitute an accumulator which accumulates the frame time data read out from frame time memory 848. The other elements are provided for controlling the accumulation of the accumulator. The output signal of flip-flop 851, i.e., the accumulated value of the accumulator is supplied to multiplier 844 as the above-described weight coefficient a. An inverter inverts all bits of the output signal of flip-flop 851. The output signal of this inverter indicates a value 1−a. The value 1−a is supplied to multiplier 844 as described above.

Figure 24:
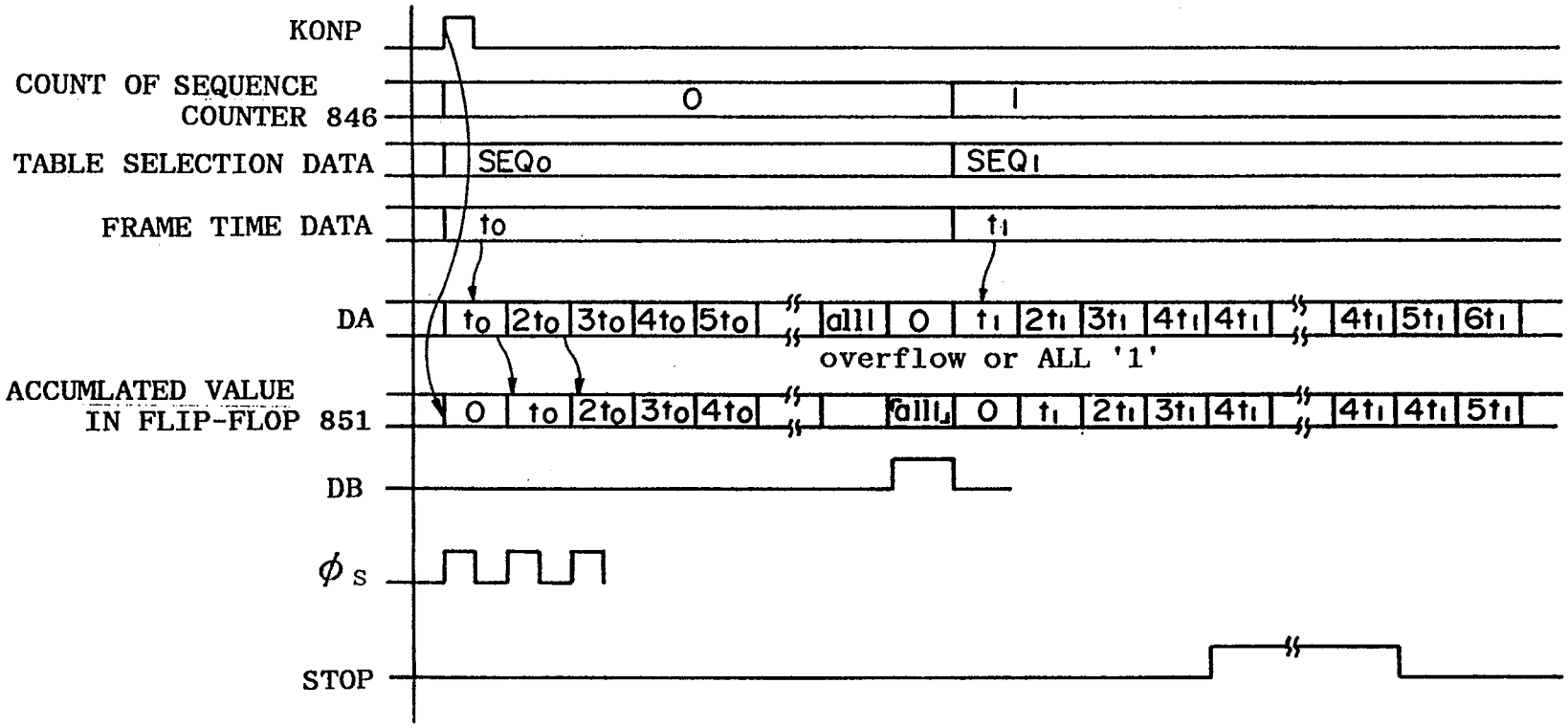
FIG. 24 is a time-chart showing the operation of the waveform processing circuit shown in FIG. 23.

Next, the operation of this waveform processing circuit will be described with reference to the time-chart shown in FIG. 24. When key-on pulse KONP rises, sequence counter 846 is reset so that the count of the counter is initialized to [0]. Furthermore, flip-flop 851 is reset by key-on pulse KONP so that the output signal of flip-flop 851 is [0]. As a result, weight coefficients are initialized as a=0 and 1−a=1. The count of sequence counter 846 is supplied to table sequence memory 847 and frame time memory 848. One of the sequence table stored in table sequence memory 847 is selected based on sequence table selection signal TBLSEQ. Table selection data in the selected sequence table is selected based on the count of sequence counter 846. At this time the first table selection data $SEQ_0$ is selected and read-out from table sequence memory 847. Accordingly, the output data of two non-linear transformation tables are selected by selector 842 in accordance with table selection data $SEQ_0$. As a result, the input waveform data are transformed to two output data based on the two non-linear transformation tables designated based on $SEQ_0$.

On the other hand, one of the frame time table stored in frame time memory 848 is selected based on frame table selection signal FT. Frame time data in the selected frame time table is selected based on the count of sequence counter 846. At this time the first frame time data is selected and read-out from frame time memory 848 because the count of sequence counter 846 is [0]. Time frame data is inverted to a value $t_O$ by Inverter 853. Value $t_O$ obtained from inverter 853 is added to a value stored in flip-flop 851 by adder 849 in the case where STOP="0". At the initial time, the added result is $t_O$ because the value stored In flip-flop 851 is [0]. The added result of adder 849 is supplied to flip-flop 851 via NOR gate 864 and AND gate 860. The added result is written in flip-flop in synchronization with clock $\phi$s. In the case where the added result of adder 849 Is less than a value in which the bits are all "1", or the carry out signal of adder 849 is "0", "0" is written as DB in flip-flop 850 in synchronization with clock $\phi$s. During DB="0", sequence counter 846 does not count clock $\phi$s and the count therefore remains [0]. The same value $t_O$ is repeatedly accumulated and the accumulated value is written In flip-flop 851 in synchronization with clock $\phi$s. The value stored in flip-flop 851 is supplied to multiplier 844 as weight coefficient a. Furthermore, the Inverted value of a, i.e., 1−a is supplied to multiplier 843. Weight coefficient a gradually increases from [0] to [1] and weight coefficients 1−a gradually from [1] to [0]. The two output data are multiplied by a and 1−a by multiplier 844 and 843. The multiplied results of the multipliers are added together by adder 845. The added result of adder 845 is output as the output waveform data. The transformation substantially applied to the input waveform data is varied from one of the selected non-linear transformation tables to the other of those in response to the variation of a and 1−a.

When the added result of adder 849 becomes a value in which the bits are all "1", or the carry out signal of adder 849 becomes "1", "1" is written as DB in flip-flop 850 in synchronization with clock $\phi$s. As a result, sequence counter 846 counts clock $\phi$s and the count thereof becomes [1]. Additionally, [0] is written in flip-flop 851 because DB="1".

Second table selection data $SEQ_1$ is read-out from table sequence memory 847 because the count of sequence counter 846 becomes [1]. The two non-linear transformation tables are selected by selector 842 based on the second table selection data. On the other hand, the second frame time data corresponding to the count [1] is read-out from frame time memory 848, and the inverted value $t_1$ is supplied to adder 849. The new added result of adder 849 is written in flip-flop 851 in synchronization with clock $\phi$s. Furthermore, "0" is written in flip-flop 850 in synchronization with clock $\phi$s so that DB returns to "0". Thereafter, value $t_1$ is accumulated in flip-flop 851 in synchronization with clock $\phi$s. Weight coefficients a and 1−a gradually vary over time.

In the case where a count stop signal STOP is generated, a value in which the bits are all "0" is supplied from AND gate 857 to adder 849. Accordingly, the accumulation of the stored value in flip-flop 851 Is stopped and the weight coefficients for multipliers 844 and 843 do not vary. Thus, the non-linear transformation substantially applied to the input waveform data is not varied during STOP="1".

FIG. 25 shows an example of table selection data A, B, C, D and two non-linear function tables selected by the table selection data. In this case, the non-linear transformation function substantially applied to the input waveform data is gradually varied over time as NL1→NL2→NL3→NL4. As a result, the tone color of the synthesized musical tone gradually varies over time.

Figure 26:
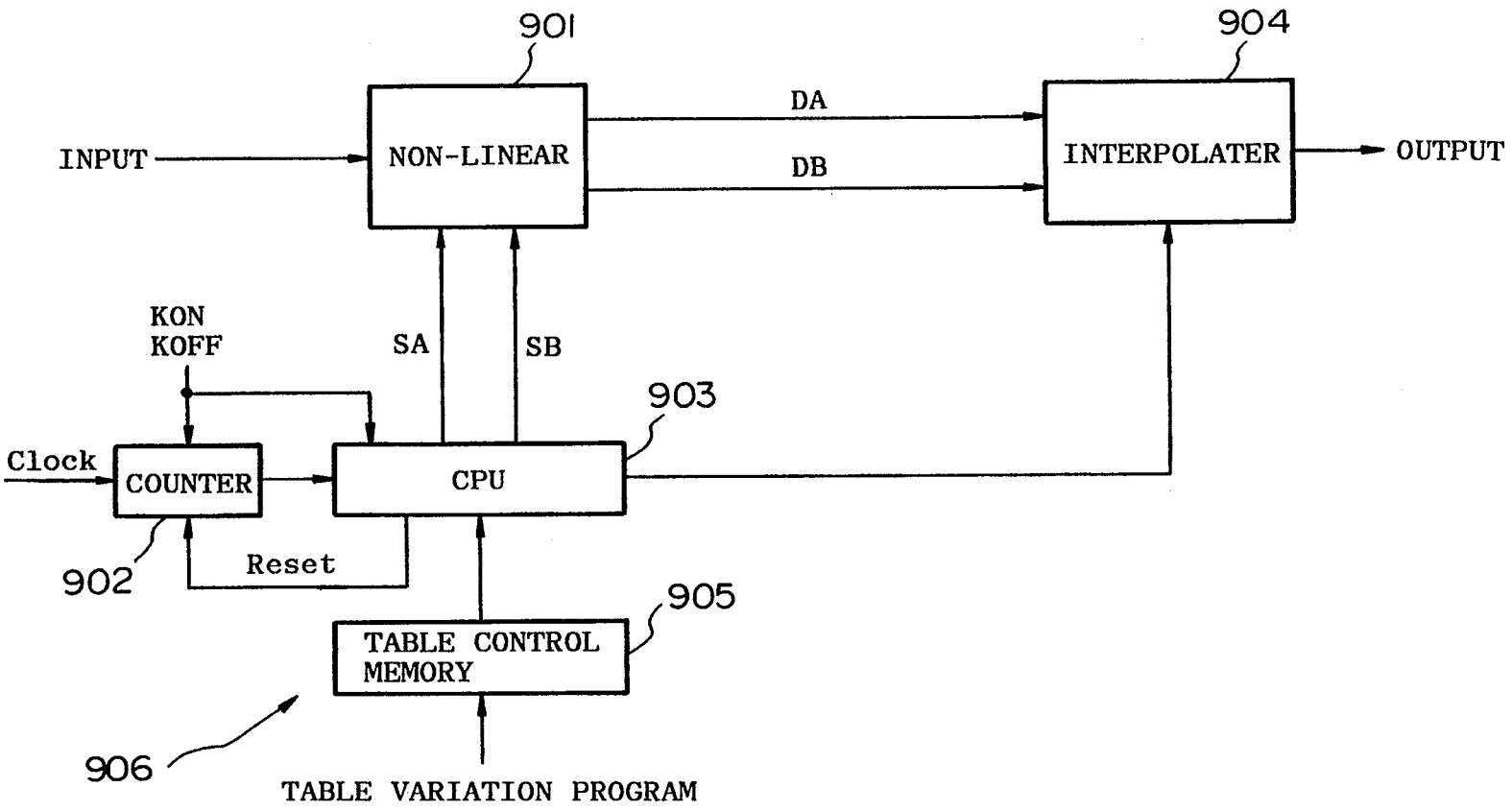
FIG. 26 is a block-diagram showing the other example of the waveform processing circuit shown in FIG. 21.

FIG. 26 shows the other example of waveform processing circuit 813. In FIG. 26, 901 designates a ROM in which a plurality of non-linear function tables is stored. 906 designates a control circuit which controls the read-out operation of ROM 901. 904 designates a interpolator which interpolates data read out from ROM 901. A counter 902, CPU (central processing unit) 903 and a table control memory 905 are provided in control circuit 906. Counter 902 counts clock $\phi$s generated at a predetermined interval while a key-on signal KON is being generated by an operational means such as a keyboard. The key-on signal indicates that any key is being depressed. When the count of counter 902 becomes a predetermined value, the next count of counter 902 is [0]. The count operation of counter 902 is stopped when a key-off signal KOFF is detected which indicates that the key previously depressed is then released. Table control memory 905 stores a table variation program containing a series of instructions which command the setting of the non-linear function tables used for the transformation of the input waveform data. This table variation program is previously stored in memory 905. CPU 903 reads out instructions from memory 905 when the count of counter 902 becomes [0]. CPU 903 then generates table selection signals SA and SB based on the read-out instruction. Two non-linear function tables are selected based on table selection signals SA and SB. CPU 903 further generates weight coefficients based on the count of counter 902. The weight coefficients are used for the interpolation operation of interpolator 904. In the case where the count of counter 902 is [0], weight coefficients are generated so that one of the output data of the non-linear function table corresponding to SA is output from interpolator 904. In the case where the count of counter 902 varies from [0], weight coefficients are generated so that the ratio of the output data of the non-linear function table corresponding to SA gradually decreases and the ratio of the output data of the non-linear function table corresponding to SB gradually increases. In this manner, weight coefficients are generated whereby the output value of the two non-linear function table selected based on SA and SB are interpolated over time in accordance with the count of counter 902, and the non-linear transformation function applied to the input waveform data is gradually varied over time. When the last instruction is read-out from memory 905 or when a key-off signal KOFF is generated, counter 902 is reset by CPU 903. When a key-on signal is generated again, the same operation is achieved as described above.

In this preferred embodiment, two read-out data are selected by the selector and the selected data are mixed with varying the mixing ratio (i.e., the above-described weight coefficients). However, three or more read-out data may be read-out and mixed.

[9] Ninth Preferred Embodiment

Figure 27:
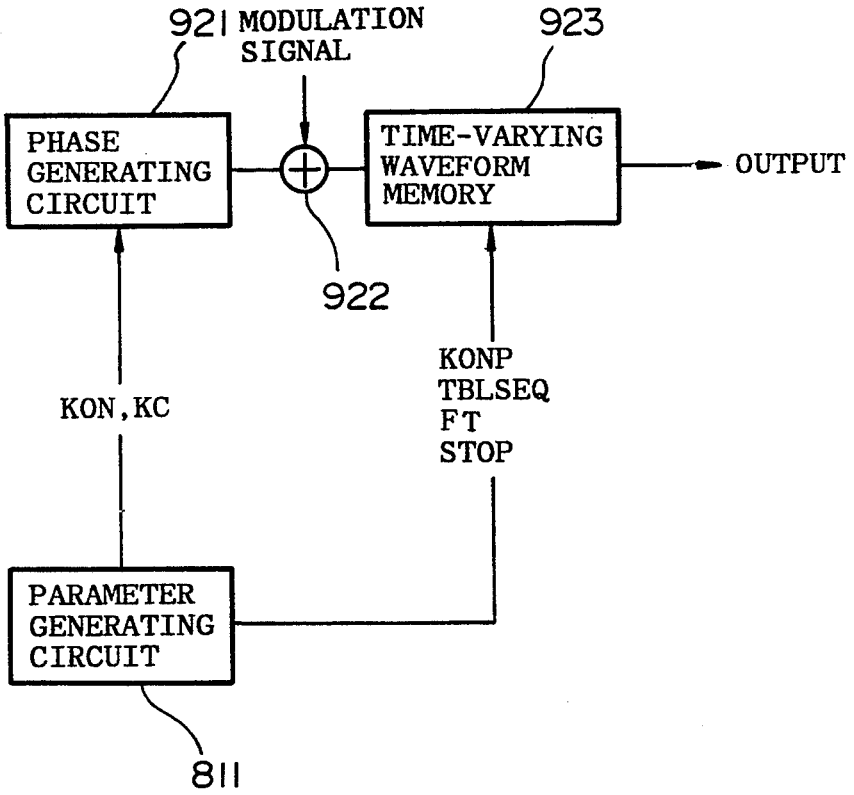
FIG. 27 is a block-diagram showing the configuration of the musical tone synthesizing apparatus of the ninth preferred embodiment of the present invention.
Figure 28A:
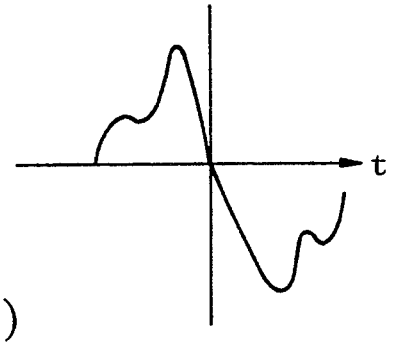
FIGS. 28(*a*) through 28(*c*) show the variation of the waveform generated In the musical tone synthesizing apparatus of the ninth preferred embodiment.
Figure 28B:
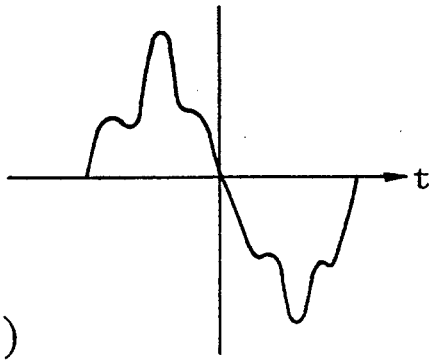
Figure 28C:
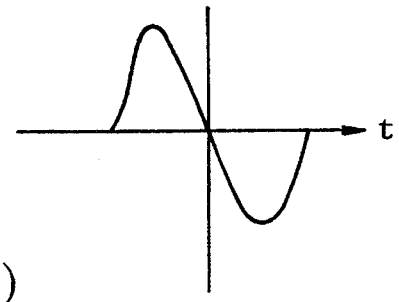

FIG. 27 is a block-diagram showing the configuration of a musical tone synthesizing apparatus of the ninth preferred embodiment. In this apparatus, parameter generating circuit 811 used for the above-described eighth preferred embodiment is provided. A phase signal generating circuit 921 generates a phase signal indicating the phase of the waveform of the synthesized musical tone. More specifically, when key-on signal KON is generated by parameter generating circuit 811, phase generating circuit 821 outputs [0] as the phase signal. Thereafter, a predetermined value corresponding to the key-code of the musical tone to be synthesized is accumulated in synchronization with a clock having a constant frequency, and the accumulated value is output by the phase signal generating circuit as the phase signal. An adder 822 adds the phase signal with a modulation waveform signal which Is generated by a LFO (Low-Frequency-Oscillator) not shown. The output signal of adder 822 is supplied to a time-varying waveform memory 823. This time-varying waveform memory has a configuration similar to the configuration shown in FIG. 23. In this time-varying waveform memory, however, non-linear transformation tables 841*a* through 841*d* in FIG. 23 are replaced by four waveform tables which store the different waveforms. An operation the same as the eighth preferred embodiment is performed by time-varying waveform memory 923 based on parameters KONP, TBLSEQ, FT and STOP. In this apparatus, the phase of the waveform data read-out from time-varying waveform memory is determined based on the phase signal. However, the waveform substantially read-out from time-varying waveform memory is gradually varied over time because waveforms are sequentially selected from all of the stored waveforms, and the selected waveforms are mixed in a manner that the mixing ratio gradually varies. FIGS. 28(*a*) through 28(*c*) shows an example of variation of the output waveform read-out from time-varying waveform memory 923.

[10] Tenth Preferred Embodiment

Figure 29:
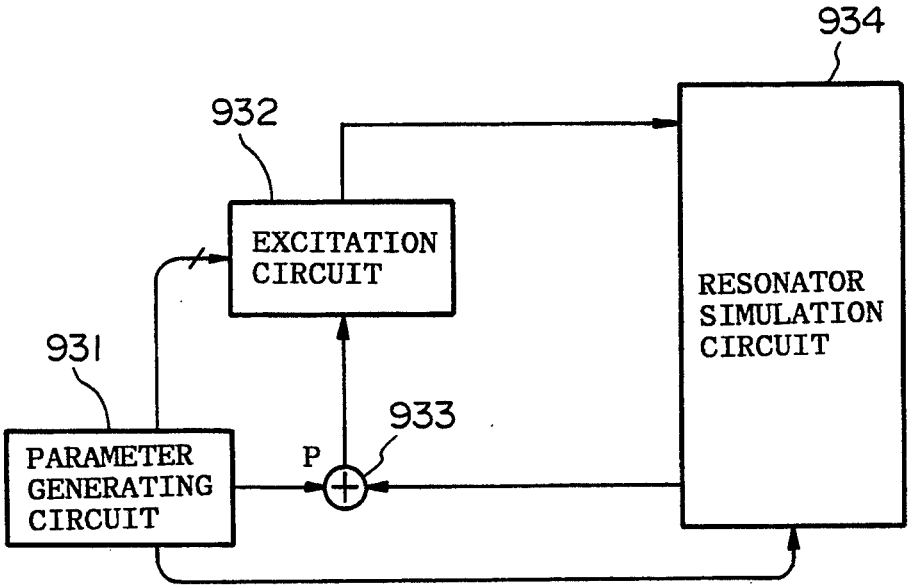
FIG. 29 is a block-diagram showing the configuration of the musical tone synthesizing apparatus of the tenth preferred embodiment of the present invention.
Figure 30A:
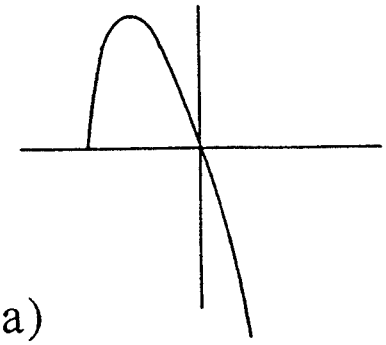
FIGS. 30(*a*) through 30(*c*) show the variation of a non-linear transformation function of the excitation circuit shown in FIG. 29.
Figure 30B:
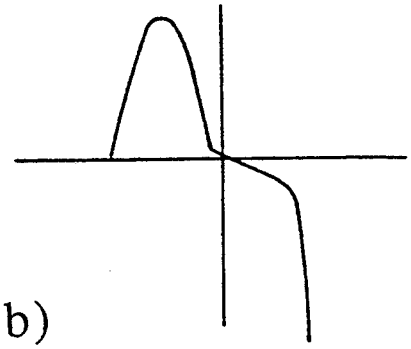
Figure 30C:
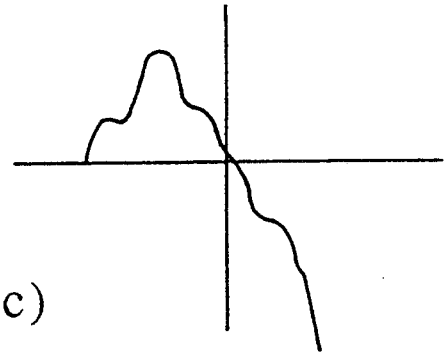

FIG. 29 shows a configuration of a musical tone synthesizing apparatus of the tenth preferred embodiment. In this apparatus, a parameter generating circuit 931, a non-linear signal processing circuit 932, an adder 933 and a resonator simulation circuit 934 are provided. This apparatus is designed so as to synthesize the musical tones of a wind instrument. Non-linear signal processing circuit 931 is provided for simulating the operation of the mouth piece portion of the wind instrument. This non-linear signal processing circuit is designed so that the non-linear transformation achieved thereby is gradually varied over time. In order to vary the non-linear transformation function, this non-linear signal processing circuit has a configuration similar to the configuration shown in FIG. 23 or FIG. 26. Resonator simulation circuit 934 is provided for simulating the operation of the resonotor tube. An FIR filter is employed in resonator simulation circuit. Filtering coefficients for the FIR filter are set by parameter generating circuit 931 based on the desired tone color.

In this apparatus, the non-linear transformation function applied to the output signal of adder 933 is varied over time as shown in FIGS. 930(*a*) through 930(*c*), for example. As a result, the tone color of the synthesized musical tone is gradually varied over time.

What is claimed is:

1. A musical tone synthesizing apparatus for generating a musical tone signal having characteristics which are gradually varied over time, the musical tone synthesizing apparatus comprising:

parameter generation means for generating control parameters in response to performance information;

excitation means for generating an excitation signal based on input signals;

a plurality of signal processing means, at least a portion of which are connected to the excitation means to form a closed-loop circuit for generating a musical tone signal, the plurality of signal processing means respectively receiving the excitation signal and transforming the excitation signal to a plurality of corresponding output signals based on the control parameters; and mixing means, connected between the plurality of signal processing means and the excitation means, for mixing the output signals of the plurality of signal processing means to produced a mixed output signal according to a mixing ratio which is varied according to the performance information, the mixed output signal being supplied to the excitation means, wherein the mixing ratio is gradually varied over time so that the characteristics of the generated musical tone signal are gradually varied over time.

2. A musical tone synthesizing apparatus according to claim 1 wherein the plurality of signal processing means include two signal processing means, each of the two signal processing means producing a respective output signal responsive to the excitation signal, the parameter generation means, responsive to variations in the performance information, generates control parameters for at least one of the two signal processing means, and the mixing means mixes the respective output signals of the two signal processing means so that one of the respective output signals gradually increases a respective contribution to the mixed output signal while the other of the two respective output signals gradually decreases a respective contribution to the mixed output signal.

3. A musical tone synthesizing apparatus according to claim 1 wherein said plurality of signal processing means includes a plurality of FIR filters, and said control parameters are provided to said plurality of FIR filters as filter coefficients.

4. A musical tone synthesizing apparatus for generating a musical tone signal whose characteristics are gradually varied over time, the musical tone synthesizing apparatus comprising:

parameter generation means for generating control parameters in response to performance information;

excitation means for generating a first excitation signal based at least one input signal;

distribution means, responsive to the first excitation signal, for producing a plurality of second excitation signals according to a distribution ratio which is varied according to the performance information; and a plurality of signal processing means, at least one of which is connected to the excitation means to form a closed-loop circuit for generating a musical tone signal, for processing the plurality of second excitation signals, the at least one signal processing means respectively transforming one of the second excitation signals to produce an output signal based on the control parameters, and respectively supplying the produced output signal to the excitation means, wherein the distribution ratio is gradually varied over time so that characteristics of the generated musical tone signal are gradually varied over time.

5. A musical tone synthesizing apparatus according to claim 4 wherein the plurality of signal processing means include two signal processing means, each of the two signal processing means producing a respective output signal responsive to a respective one of the plurality of second excitation signals, the parameter generation means, responsive to variations in the performance information, generates control parameters for at least one of the two signal processing means, and the distribution means changes the distribution ratio among the two signal processing means so that the second excitation signal supplied to one of the two signal processing means gradually increases while the second excitation signal supplied to the other of the two signal processing means gradually decreases.

6. A musical tone synthesizing apparatus according to claim 4 wherein said plurality of signal processing means includes a plurality of FIR filters, and said control parameters are provided to said plurality of FIR filters as filter coefficients.

7. A musical tone synthesizing apparatus for generating a musical tone signal whose characteristics are gradually varied over time, the musical tone synthesizing apparatus comprising:

a plurality of non-linear transformation means, each including a corresponding non-linear transformation function, for transforming a common input signal into a plurality of output signals based on the corresponding non-linear transformation functions;

variation control means for generating a function selection signal indicative of at least two non-linear transformation means, the function selection signal being varied over time;

selection means for selecting at least two non-linear transformation means in accordance with the function selection signal; and mixing means for mixing the output signal from each selected non-linear transformation means in accordance with a mixing ratio which is gradually varied over time to produce a mixed output signal coefficients.

8. A musical tone synthesizing apparatus according to claim 7, wherein said variation control means includes memory means for storing function selection data, and said variation control means sequentially reads out said function selection data from said memory means as said function selection signal.

9. A musical tone synthesizing apparatus according to claim 7, wherein said variation control means includes memory means for storing a plurality of function selection tables each including a series of function selection data, and means for selecting a respective function selection table based on a desired musical tone, said variation control means reading out said function selection data of the selected function selection table from said memory means as said function selection signal.

10. A musical tone synthesizing apparatus according to claim 7, further comprising:

variation rate control means for controlling the variation rate by which said mixing ratio varies.

11. A musical tone synthesizing apparatus according to claim 10 wherein said variation rate control means includes memory means for storing a series of rate data, and accumulator means for accumulating data read from said memory means in synchronization with a clock having a predetermined value.

12. A musical tone synthesizing apparatus according to claim 10 wherein said variation control means includes a memory which stores a plurality of rate sequence tables each presenting a series of rate data and an accumlator for accumlating the read-out data from said memory in synchronization with a clock having a predetermined frequency and for outputting the accumlated value as said mixing ratio, whereby said variation control means selects the rate sequence table based on a desired musical tone, reads out said rate data of the selected rate sequence table from said memory and resets the value accumlated in said accumlator after the accumlated value in said accumlator exceeds a predetermined value.

13. A musical tone synthesizing apparatus according to claim 7, further comprising:

linear signal processing means for carrying out at least one delay operation on an input signal thereto, wherein said non-linear transformation means, said mixing means and said linear processing means are connected so as to form a closed-loop.

14. A musical tone synthesizing apparatus according to claim 7, further comprising:

waveform generating means for generating a waveform corresponding to a desired musical tone, wherein said waveform is input to said plurality of non-linear transformation means, and the mixed output signal of said mixing means is output as a musical tone signal.

15. A musical tone synthesizing apparatus according to claim 7 wherein said non-linear transformation means is a plurality of memories which store non-linear function tables, and said input signal is supplied to said memories as a read-out address.

16. A musical tone synthesizing apparatus for generating a musical tone signal whose characteristics are varied over time, said musical tone synthesizing apparatus comprising:

at least one linear signal processing means for performing linear signal processing, including delay processing, on an input signal, and for outputting the results of the signal processing as at least one linear output signal;

a plurality of non-linear signal processing means for performing non-linear signal processing on a corresponding plurality of input signals and outputting the results of said non-linear signal processing as a corresponding plurality of non-linear output signals;

envelope generating means for generating a corresponding plurality of envelope signals respectively corresponding to the non-linear output signals of the plurality of non-linear signal processing means;

a plurality of output level control means for controlling the level of the non-linear output signals of the plurality of non-linear signal processing means based on the corresponding plurality of envelope signals; and junction means for forming an interface between the plurality of non-linear signal processing means and the plurality of linear signal processing means, said junction means including mixing means for mixing the at least one linear output signals and the plurality of non-linear output signals and generating input signals for the at least one linear signal processing means and the plurality of non-linear signal processing circuits based on the mixing results.

17. A musical tone synthesizing apparatus according to claim 16 wherein said envelope generating means sequentially generates said envelope signals so that each envelope signal gradually rises while the last envelope signal gradually falls.

* * * * *